US006928734B1

(12) United States Patent
West

(10) Patent No.: US 6,928,734 B1
(45) **Date of Patent: *Aug. 16, 2005**

(54) JEWELRY RING AND METHOD OF MANUFACTURING SAME

(76) Inventor: Trent West, 41 Hangar Way, Watsonville, CA (US) 95076

( * ) Notice: Subject to any disclaimer, the term of this patent is extended or adjusted under 35 U.S.C. 154(b) by 107 days.

This patent is subject to a terminal disclaimer.

(21) Appl. No.: 10/426,054

(22) Filed: Apr. 28, 2003

(51) Int. Cl.[7] ..... A44C 9/00
(52) U.S. Cl. ..... 29/896.412; 63/15
(58) Field of Search ..... 29/896.412, 896.411; 416/18; 63/15, 3; 419/42, 46, 53–55; D11/26, 39

(56) References Cited

U.S. PATENT DOCUMENTS

| | | | | |
|---|---|---|---|---|
| 1,654,335 A | | 12/1927 | Lindroth | |
| 1,689,124 A | | 10/1928 | Fitzgerald | |
| 2,016,679 A | | 10/1935 | Mayer | 63/15 |
| 2,027,060 A | | 1/1936 | Niven et al. | 63/15 |
| 3,409,416 A | | 11/1968 | Yates | 29/182.5 |
| 3,413,392 A | * | 11/1968 | Meadows | 264/102 |
| 3,417,223 A | | 12/1968 | Steigerwald | 219/121 |
| 3,606,766 A | | 9/1971 | Hill | 63/15 |
| 3,669,695 A | | 6/1972 | Iler et al. | 106/43 |
| 3,719,479 A | | 3/1973 | Flanagan | 75/226 |
| 3,725,634 A | | 4/1973 | Lane | 219/121 |
| 3,776,706 A | | 12/1973 | Daniels et al. | 29/182.5 |
| 3,901,717 A | | 8/1975 | Revaz | 106/42 |
| 4,090,284 A | | 5/1978 | Kraft | 29/159.3 |
| 4,281,235 A | | 7/1981 | Peloquin | 219/121 |
| 4,387,627 A | | 6/1983 | Avezou | 92/222 |
| 4,549,058 A | | 10/1985 | DelMastro et al. | 219/121 |
| 5,431,028 A | * | 7/1995 | Lampert et al. | 63/33 |
| 5,462,772 A | | 10/1995 | Lemelson | 427/554 |
| 5,968,428 A | * | 10/1999 | Kuwabara | 264/86 |

FOREIGN PATENT DOCUMENTS

| | | | |
|---|---|---|---|
| AU | 208883 | | 5/1956 |
| GB | 2 210 249 | | 6/1989 |
| JP | 56084375 A | * | 7/1981 |
| JP | 9268241 | | 10/1997 |
| WO | WO 99/12443 | | 3/1999 |
| WO | WO 02/21962 | | 3/2002 |

OTHER PUBLICATIONS

Sharr Choate, "Creative Gold– and Silversmithing," 1970, pp. 58–68, 139–150; 165–170, 188, 245–264.

* cited by examiner

*Primary Examiner*—Marc Jimenez
(74) *Attorney, Agent, or Firm*—Winston & Strawn LLP

(57) ABSTRACT

Methods are provided of making annular, tungsten-carbide jewelry articles including finger rings, bracelets, earrings, body jewelry, and the like. Advantageously, the methods include providing a tungsten-carbide based annular jewelry article having a desired surface profile and including an annular band that includes providing a mixture of two or more powdered materials of at least 50 weight percent to about 90 weight percent tungsten carbide to form the annular band of the article into a pressure mold having a cavity of predetermined annular configuration and sized formed therein, the size of the mold being greater than the final size of the annular band, compressing the powdered material mixture at a pressure sufficient to form an annular blank, and sintering the annular blank at a temperature sufficient to form the tungsten-carbide based annular jewelry article so as to be long wearing and virtually indestructible during normal use thereof.

36 Claims, 15 Drawing Sheets

JEWELRY RING AND METHOD OF MANUFACTURING SAME

FIELD OF THE INVENTION

The present invention relates generally to an apparatus and method for manufacturing a composite article and to the article manufactured by that apparatus and method, and more particularly to an apparatus and method for manufacturing an article having a hard, wear-resistant component and a softer, more malleable component, such as articles made from "hard" metals and/or ceramic materials either alone or in combination with precious metals and jewels such that the hardened materials protect the softer precious metals and jewels from edge and detail wear down, including to jewelry items such as finger rings, bracelets, earrings, body jewelry, and the like, and medical or industrial devices or components.

BACKGROUND OF THE INVENTION

Jewelry has for centuries been made of soft materials such as gold, silver, platinum and other soft materials because such metals were malleable, and easily cast, forged, molded or otherwise formed. However, whereas such materials are relatively easy to form, shape and polish, they are equally subject to wear, scratching and other damage detracting from their longevity appearance and value, i.e., wearing down of edges to a smooth and rounded state.

More recently, science has produced other materials including tungsten, cemented carbide and high-tech ceramics that are much harder than the previously mentioned precious metals, and once formed, are virtually indestructible when used in a normal jewelry wearing environment. One problem with such materials is that because of their hardness, they are very difficult to shape, and once formed, require special machining and/or grinding tools to alter their configuration and appearance. Accordingly, with the exception of articulated watch bands or housings for certain timepieces, such materials have historically not been used for articles of jewelry of the types mentioned above. However, I have recently discovered that through the use of powder metallurgy and sintering processes, such materials can be manufactured and used to provide faceted designs that were not heretofore practiced. Furthermore, such materials can be used to enhance and protect precious metals and gemstones in this jewelry setting.

In the process of fabricating parts from powdered metals, the most important step is one involving the welding together of the metallic powder to form a solid which will yield the proper shape and the properties required of the finished part. Although a good weld cannot be made between metals at room temperature by pressure alone, when the metal particles are relatively fine and plastic, a welding may occur that is satisfactory from the view point of handling, although little or no strength will be developed. Under pressure, at room temperature, metal powders that are plastic and relatively free from oxide films, may be compacted to form a solid of the desired shape having a strength (green strength) that allows the part to be handled.

This result is often called cold-welding. The welding under pressure of the metal particles in order form a solid blank of the shape desired, requires the use of pressures varying from 5 to 100 tons-per-square inch. Relatively light loads are used for the molding of the solder and more plastic metals, while pressures approaching 100 tons per square inch are necessary when maximum density is needed and when pressing relatively hard and fine metal powders such as those mentioned above are used in accordance with the present invention. Commercial pressing is done in a variety of presses which may be of the single mechanical punch-press type or the double—action type of machine that allows pressing from two directions by moving upper and lower punches synchronized by means of cams. These machines also incorporate moveable core rods which make it possible to mold parts having long cores, assist in obtaining proper die fills and help in the ejection of the pressed parts.

The molding of small parts at great speeds and at relatively low pressures can be accomplished using the mechanical press. For example, mechanical presses can produce parts at the rate of 300 to 30,000 parts per hour. A satisfactory press should meet certain definite requirements among which are the following: (1) sufficient pressure should be available without excessive deflection of press members; (2) the press must have sufficient depth of fill to make a piece of required heights dependent upon the ratio of loose powder to the compressed volume, this being referred to as the compression ration; (3) a press should be designed with an upper or lower punch for each pressing level required in the finished part, although this may be taken care of by a die design with a shoulder or a spring mounted die which eliminates an extra punch in the press; and (4) a press should be designed to produce the number of parts required. The punches are usually made from an alloy of tungsten carbide or punched steel that can be hardened by oil quenching.

Heating of the cold-welded metal powder is called the "sintering" operation. The function of heat applied to the cold-welded powder is similar to the function of heat during a pressure-welding operation of steel in that it allows more freedom for the atoms and crystals; and it gives them an opportunity to re-crystalize and remedy the cold deformation or distortion within the cold pressed part. The heating of any cold-worked or deformed metal will result in re-crystallization and grain growth of the crystals or grains within the metal. This action is the same one that allows one to anneal any cold work-hardened metal and also allows one to pressure-weld metals. Therefore, a cold-welded powder will re-crystalize upon heating, and upon further heating, the new crystals will grow, thus the crystal grains become larger and fewer.

The sintering temperatures employed for the welding together of cold-pressed powders vary with the compressive loads used, the type of powders and the strength required of the finished part. Compacts of powders utilized in accordance with the present invention are typically sintered at temperatures ranging from about 1000° C. to in excess of 2000° C. for approximately 30 minutes. When a mixture of different powders is to be sintered after pressing and the individual metal powders in the compact have markedly different melting points, the sintering temperatures used can be above the melting point of one of the component powders. The metal with a low melting point will thus become liquid; however, so long as the essential part or major metal powder is not molten, this practice may be employed. When the solid phase or powder is soluble in the liquid metal, a marked dilution of the solid metal through the liquid phase may occur which will develop a good union between the particles and result in a high density.

Most cold-pressed and metal ceramic powders shrink during the sintering operation. In general, factors influencing shrinkage include particle size, pressure used in cold-welding, sintering temperature and time employed during the centering operation. Powders that are hard to compress will cold-shrink less during sintering. It is possible to control the amount of shrinkage that occurs. By careful selection of the powder and determination of the correct pressure for cold-forming it is possible to sinter so as to get minimal volume change. The amount of shrinkage or volume change should be determined so as to allow for this change in the design of the dies used in the process of fabricating a given shape.

The most common type of furnace employed for the sintering of pressed powders is the continuous type. This type of furnace usually contains three zones. The first zone warms the pressed parts and the protective atmosphere used in the furnaces purges the work of any air or oxygen that may be carried into the furnace by the work or trays. This zone may be cooled by water jackets surrounding the work. The second zone heats the work to the proper sintering temperature. The third zone has a water jacket that allows for rapid cooling of the work; and the same protective atmosphere surrounds the work during the cooling cycle.

Protective atmospheres are essential to the successful sintering of pressed powders. The object of such an atmosphere is to protect the pressed powders from oxidation which could prevent the successfully welding together of the particles of metal powder. Also if a reducing protective atmosphere is employed, any oxidation that may be present on the powder particles will be removed and thus aide in the process of welding. A common atmosphere used for the protection and reduction of oxides is hydrogen. Water vapor should be removed from the hydrogen gas by activated alumina dryers or refrigerators before it enters the furnace.

Many of the same problems and limitations experienced in the jewelry industry also pertain to the medical, dental, industrial, and scientific fields where there is a need for articles having particular structural and/or metallurgical or compositional properties have been difficult to manufacture.

Therefore there remains a need for articles having properties that are best met using composite materials, and methods, apparatus, and systems for making such articles.

SUMMARY OF THE INVENTION

The invention includes system, apparatus, and method for making articles including jewelry. Such system and method are particularly well adapted to make composite articles having a hard, wear-resistant component and a softer, more malleable component. It also provides for making a non-composite article having only the hare wear-resistant material but without the softer malleable component. One such article is an article made from "hard" metals and/or ceramic materials either alone or in combination with precious metals and jewels such that the hardened materials protect the softer precious metals and jewels from edge and detail wear down. Another such article is an article made from "hard" metals and/or ceramic materials either alone that has rounded, curved, flat, faceted, or rounded surfaces, or a combination of such surfaces. Jewelry items such as finger rings, bracelets, earrings, body jewelry, and the like, are particular example of such articles. Medical, dental, and industrial devices or components are other examples of such articles. Furthermore, while the manufacturing method or process is particularly well suited to articles having a wear resistant component and a softer wearable component, the inventive method is not limited to such hard and soft constituents. Other embodiments of the manufacturing method or process are particularly well suited to articles having a wear resistant component only.

In one aspect, the invention provides a method of manufacturing a composite article including a substrate comprising a first material and an inlay comprising a second material. The method includes the steps of preheating the substrate; contacting a depression in a surface of the substrate with the second material; heating the second material at a point contact with the substrate causing it to liquefy and flow into the depression; and moving the point of contact along the along the depression in the surface of the substrate while feeding (continuously, intermittently, occasionally, or otherwise as required or desired to fill or partially fill the groove) the second material and heating the second material at the point contact with the substrate to cause it to substantially fill the depression. The method may also optionally include generating the heat using an electron beam, applying a de-focused electron beam to the surface of the substrate to preheat the substrate, and applying a focused electron beam to the second material at the point contact with the substrate. Here, the process is advantageously carried out in a vacuum or oxygen-free or substantially oxygen-free or atmospheric environment.

The preheating is normally accomplished using a temperature of between about 70 percent and about 95 percent of the temperature of fusion of the second material though higher and lower temperatures may be used, more typically about 80 percent to 90 percent of the temperature of fusion. In one embodiment the temperature is at least 80% of the temperature of fusion and in another embodiment it is at least 90% of the temperature of fusion. Advantageously, the preheating should be accomplished gradually to minimize the possibility of heat or thermal shock that might tend to crack or distort the sintered ceramic, tungsten carbide, or tungsten material.

The inventive method may be utilized with a cylindrical, spherical, or ring-shaped substrate having an outer surface and wherein the depression comprises a groove disposed circumferentially therein, and wherein the step of moving the point of contact along the depression in the surface of the substrate includes rotating the substrate to move the point of contact along the groove. In some embodiments the substrate is rotated a plurality of rotations while in other embodiments a single rotation is sufficient. The plurality of rotations are advantageously used when the groove is being filled incrementally or a little at a time with a relatively fine or small diameter wire. Fewer revolutions may be required when a larger diameter wire is being used. A single revolution may only be required if a metal band or insert, or a plurality of inserts, have been placed in the groove and the subsequent heating is used to liquefy and fuse or join the groove filling (or partially filling) material with the ring substrate.

In another aspect, the invention provides a method of manufacturing a composite article including a cylindrical, spherical, annular, or ring-shaped substrate comprising a first material and a metal wire comprising a second material, where the method includes the steps of: joining ends of the metal wire to form a metal ring (or otherwise fabricating or machining to form a seamless metal ring or other article such as for example but not limitation by using seamless or seamed metal tubing or pipe) having an inner diameter greater than an outer diameter of the ring-shaped substrate; placing the metal ring over a groove disposed circumferentially in an outer surface; placing the substrate with the metal ring thereon on a mandrel; positioning the mandrel in a collet in an opening of a collet-block, the collet comprising a tapered hollow cylinder having a plurality of tines capable of being deformed radially inward to squeeze the metal ring into the groove the ring-shaped substrate, the collet tapering from a maximum outer diameter proximal to a top end of the collet to a minimum outer diameter distal from the top end, and the opening in the collet-block comprising a inner diameter that tapers from a maximum proximal to a top surface of the collet-block to a minimum distal from the top surface; and forcing the collet with the mandrel positioned therein into the opening; so that the metal ring is squeezed into the groove in the ring-shaped substrate to form the composite article.

The invention further includes an object or article formed or manufactured using any of the inventive systems, apparatus, and/or method.

It is therefore a principal objective of the present invention to provide novel items formed from a combination of different materials and a system and method for making such items.

BRIEF DESCRIPTION OF THE DRAWINGS

These and various other features and advantages of the present invention will be apparent upon reading of the following detailed description in conjunction with the accompanying drawings, where.

DETAILED DESCRIPTION OF THE EMBODIMENTS

The invention includes system, apparatus, and method for making composite articles particularly to an apparatus and method for manufacturing an article having a hard, wear-resistant component and a softer, more malleable component. One such article is an article made from "hard" metals and/or ceramic materials either alone or in combination with precious metals and jewels such that the hardened materials protect the softer precious metals and jewels from edge and detail wear down. Jewelry items such as finger rings, bracelets, earrings, body jewelry, and the like, are one particular example of such articles. Medical, dental, and industrial devices or components are other examples of such articles. Furthermore, while the manufacturing method or process is particularly well suited to articles having a wear resistant component and a softer wearable component, the inventive method is not limited to such hard and soft constituents. The broad applicability of the inventive articles and method for making such articles will become more apparent in light of the description and drawings provided herein.

Figure 1:
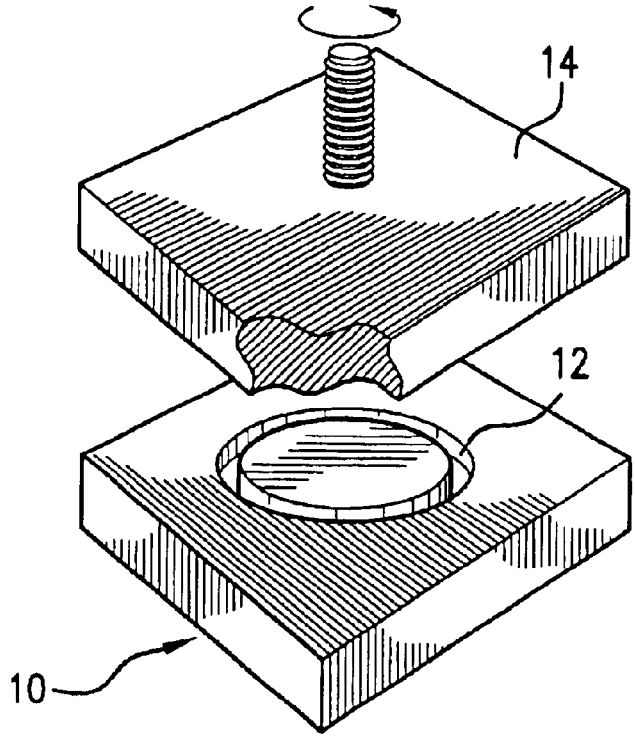
FIG. 1 is a diagram schematically illustrating a press mold of a type used to make jewelry articles in accordance with the present invention.

Referring now to FIG. 1 of the drawing, a compressive mold is depicted at 10 including an annular cavity 12 generally illustrated and configured to receive a quantity of powdered hard metal or high tech ceramic material that can be compressed and formed into an oversized "green" ring blank by the application of compressive forces applied by a mating press member 14. The mold 10 may be made in any configuration suitable for forming a particular annular or other shape, and the illustrated cavity is sized to as to produce an annular blank that, following shrinkage during subsequent processing, will have a predetermined size and configuration. Numerous types of powdered materials can be used in accordance with the present invention. One such powder includes the following constituents:

| | |
|---|---|
| Nickel | 2% to 10% |
| Cobalt | 1% to 2% |
| Chromium or Chromium Carbide | 0.5% to 3% |
| Tungsten or Tungsten Carbide | balance |

Whereas in this example, Nickel and Cobalt are used as binder materials, other materials such as palladium, platinum, ruthenium iridium and gold or alloys thereof, may also be used.

A ceramic composition might include, among many possible compositions:

| ZIRCONIA (wt. %) | |
|---|---|
| $ZrO_2 + HfO_2$ | 99% |
| $SiO_2$ | 0.20% |
| $TiO_2$ | 0.15% |
| $Fe_2O_3$ | 0.02% |
| $SO_3$ | 0.25% |
| LOI @ 1400° | 0.30% |

Whereas in this example, $ZrO_2$+$HfO_2$ is used as the matrix material, silicon nitrides, silicon carbides and other similar materials may be used. In addition, various castoring agents may be included in the binding materials.

In another embodiment, the powder is at least 80 percent tungsten carbide. In another embodiment, the powder is at least 50 percent tungsten carbide. Other embodiments provide for a powder having any amount of tungsten carbide between about 50 and about 90 percent. The relative amounts of the other constituents being adjusted accordingly. Desirably, the composition of the materials should be a hypoallergenic composition as to the portions that contact the human skin. There may be particular need or desirability to control the amount of nickel to reduce any skin sensitivity.

Figure 2:
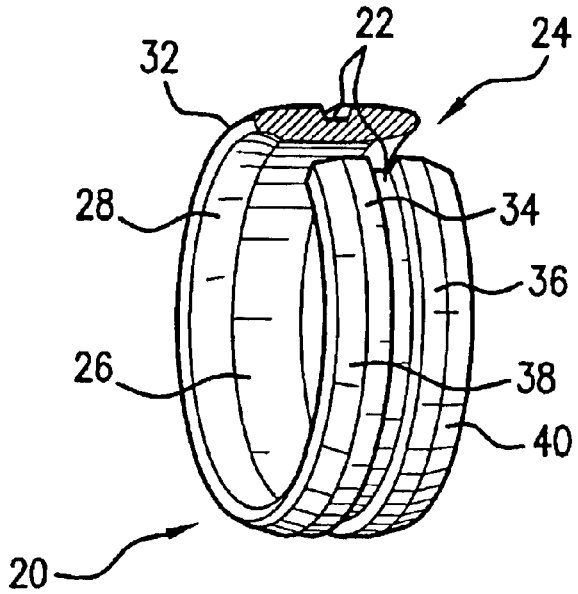
FIG. 2 is a partially broken perspective view illustrating details of one form of a molded ring component in accordance with the present invention.

In FIG. 2 of the drawing, one configuration of a ring is illustrated at 20 and includes an annular external grove 22 formed in the outer surface thereof. As illustrated in the cross-section shown in broken section at 24, the centralmost portion 26 of the internal surface of the blank 20 is cylindrical with the outboard portions or facets 28 being angled relative thereto at angles typically in the range of from 1° to 30 relative to surface 26. The axial extremes of the cross-section of this embodiment are generally semicircular, as illustrated at 32, and the outer surface is configured to have cylindrical flats 34 and 36 on opposite sides of grove 22, and angled facets or flats 38 and 40 on the opposite sides thereof. As an alternative, the facets 38 and 40 may be configured to have multiple facet surfaces.

Figure 3:
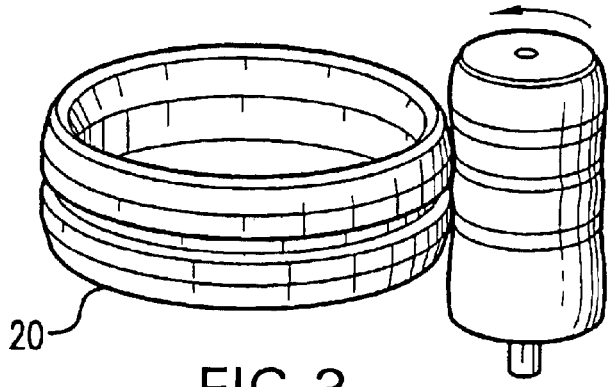
FIG. 3 is a perspective view illustrating one step in the preparation of a ring component in accordance with the present invention.
Figure 4:
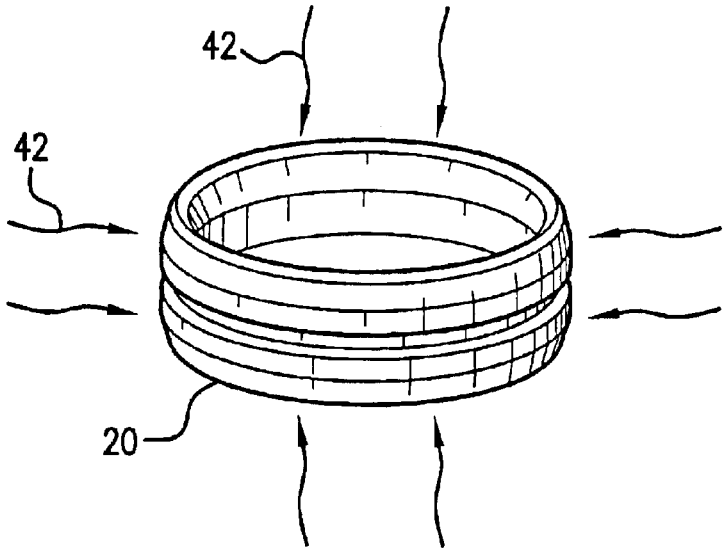
FIG. 4 is an illustration depicting a sintering step in accordance with the present invention.

Once removed from the mold, the blank 20 is shaped by machinery filing, grinding, sanding, trimming or other appropriate techniques and may be burnished as illustrated in FIG. 3 to provide a smooth or textured surface, and made ready for sintering. Alternatively, as described below, a desired shape or cross-section may be achieved by such machinery filing, grinding, sanding, trimming burnishing, or other appropriate techniques after sintering. This post sintering shaping may be advantageous as it reduces the need to handle and process the somewhat fragile substrate blanks and reduces the likelihood or possibility of producing an exposure reaction in the processing to the unbound constituent materials.

Once prepared, the blank 20 is inserted into a sintering oven and the temperature raised as suggested by the arrows 42, to a suitable sintering temperature for a predetermined period of time during which the blank becomes hardened and shrinks to a size appreciably smaller than the size of the original green blank. However, as indicated above, the mold was sized taking into consideration the anticipated subsequent shrinkage and as a result, the ring stock after sintering, has a predetermined size. This, of course, implies that a different mold will be required for each ring size. As an alternative, it will be understood that the blank may be pressed to have a tubular configuration from which multiple rings may be severed and machined to appropriate individual sizes.

Figure 5:
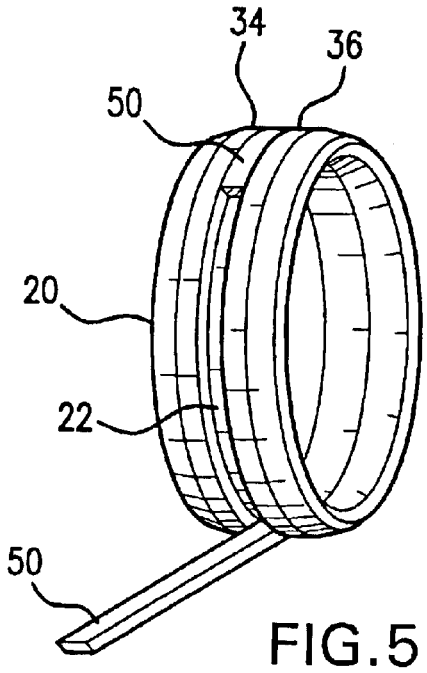
FIG. 5 is a perspective view illustrating one method of combining a precious metal component with a hard metal and/or ceramic component in accordance with the present invention.

Following the sintering operation, the ring stock can be ground and finish polished, and when appropriate, have a selected precious metal and/or other material installed in the groove 22 as suggested by the laying in of the soft metal strip 60 depicted in FIG. 5 of the drawings. Once the metal strip 50 is suitably installed using methods well known to jewelers, the assembly can be finish polished and made ready for market. It will, of course, be appreciated that other forms of materials can be inlaid into the groove 22. For example, preformed metal, stone, ceramic, shell or other segments could be glued or otherwise affixed to the ring. Preferably, such items will be slightly recessed below the surfaces of the facets 34 and 36 so as to be protected thereby.

It is during the process in which the ring stock is ground and polished that a ring having the desired surface profile, shape, or contour may be achieved. The number and angles of the surfaces may be chosen to determine the number of facets. In some instances, some number of facets or flat portions may be ground that are subsequently smoothed to provide a more-or-less continuous surface. A variety of different curved, rounded, faceted, and/or non-faceted surfaces may be combined in innumerable ways to form a ring having arbitrary cross-sectional shape. Rounded edges may be referred to for convenience as radius edges. Facets may be formed longitudinally, transversely, on frusto-conical surfaces so that portions of surfaces have compound or combination surface effects, or in other ways. For rings having inserts these grinding and polishing operations may be performed before providing for the insert, after providing the insert, or both before and after. Advantageously, as much of the finished shape and surface is achieved prior to providing the insert as possible to reduce the loss of the precious metal, such as gold or platinum, or other insert material.

Figure 6:
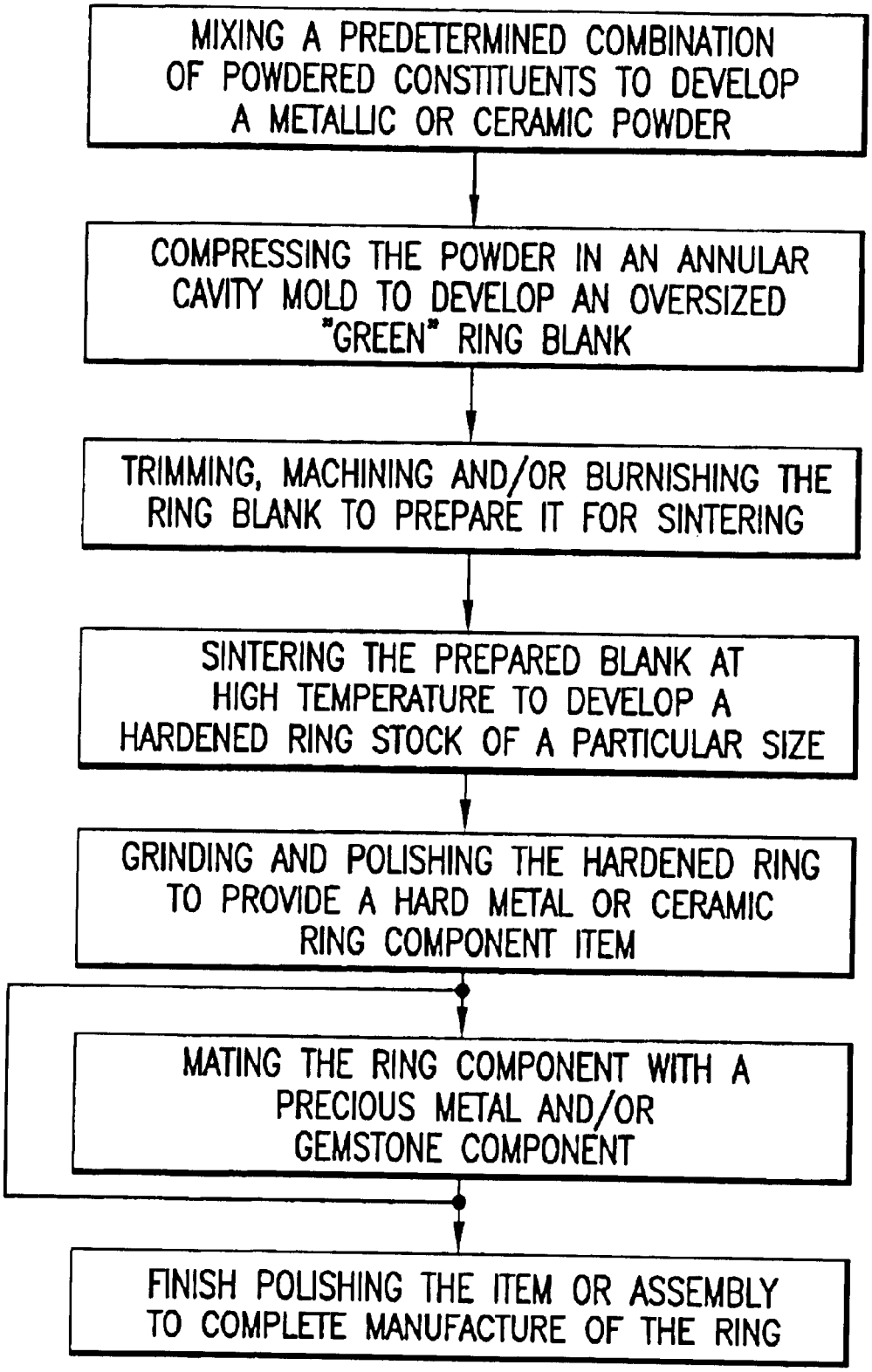
FIG. 6 is a flow chart illustrating steps followed to make jewelry in accordance with one embodiment of the present invention.

Turning now to FIG. 6, which is a flow diagram illustrating the various steps followed in a preferred method of making wring in accordance with the present invention. It will be noted that once a suitable press and mold has been prepared, the first step in making a ring or other object is to mix a predetermined combination of powdered metal of ceramic constituents to develop a sinterable metallic or ceramic powder. Once properly measured and disposed within the mold cavity, the powder will be compressed by the mold to develop an oversized "green" ring blank that, although somewhat fragile, is stable enough to allow certain processing to be accomplished prior to sintering. For example, mold lines may be trimmed and smoothed surfaces may be sanded or textured, facets may be smoothed etc. But once properly prepared, the next step is to load the blank at room temperature into a non-atmospheric sintering chamber and raise the temperature thereof to controlled temperatures, typically varying between 1000° C. to 2000° C. and then slowly cooled back to atmospheric temperature. Once cooled, the hardened ring stock or other blank configuration can be ground and polished to provide the hard metal or ceramic ring component. At this point, precious metal components, jewels and other decoration components may be affixed to the hard metal or ceramic part. One way to affix precious metal to the part is to use a brazing process and provide the components in varied shapes of wire sheet tubing or segments of other material that can be fabricated or forged into appropriate configurations and fit into the mating groove or channel 22. Fluxed or flux free gold or silver soldered compounds varying in color and purity between 50% and 99% purity can be applied on or around desired mating surfaces of the hard material as well as the precious metal or other materials after mechanically binding the parts together with round or flat wire or heat resistant custom fixtures. Prepared fixtures with parts are then loaded at room temperature into a non-atmospheric chamber and heated to controlled temperatures varying between 1000° to 2000° C. and then allowed to cool down slowly to atmospheric temperature. This braising operation will not interfere with the previously configured hard metal or ceramic components since their melting temperatures are substantially higher. A electron beam braising process described elsewhere may alternatively be used.

Another method of mating the precious metal or other components to the hardened component is to engineer the hardened component with various features such as holes, notches, slots, etc., such that various pre-shaped precious metal or other materials in mating configurations may be snapped or pressed, swaged or burnished into the hardened substructure. The resulting mechanical fit will hold the components together.

Still another method of mating the precious metal or other components to the hardened component is to bond them to the hardened part by means of one or two part hardening resin compounds that are heat and room temperature cured.

Also precious metals can be directly cast into cavities in hard metal or ceramic articles using lost wax techniques widely used in jewelry making.

But not withstanding the process used to mate the components together, once the several components are in fact combined, the entire assembly can be finished and polished to complete manufacture of the ring or other article of jewelry.

Turning now to FIGS. 7 through 14, various cross-sectional configurations of rings are depicted illustrating combinations of flats, facets, materials, inserts and component relationships. More specifically, in FIG. 7, a sintered metal part 60 is shown having a wide annular groove 62 formed in its outer surface and filled with a softer precious metal or other material 64. The top surface of material 64 may be flush with the top edges 66 of the facets 68 or may be recessed there beneath to enhance the protective function of the hardened metal part 60. This ring might have an axial length of 2–14 mm, wall thickness of 1–2.8 mm and have facets at angles of from about 2% to 40% relative to the cylindrical surface 69. Other rig axial lengths, wall thicknesses, facet angles (where facets are present), or other structural or decorative features may be provided. For embodiments having gemstones, crowns, or other decorative features attached, overall dimensions of the ring or other jewelry items may increase appropriately.

Figure 8:
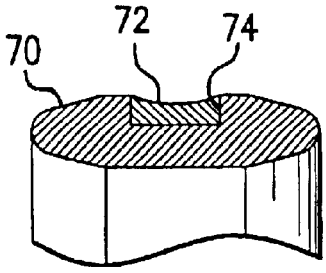

In FIG. 8, a similar ring design is depicted, but in this case, utilizing a ceramic material as the hard surfaced part 70 with the sculpted precious metal part 72 being mounted within a groove 74 formed in the outer perimeter of the hard part 70. Note the different surface effects that can be achieved by increasing the angular relationship of the various facets and by depressing or recessing the surface of the insert 72.

Figure 9:
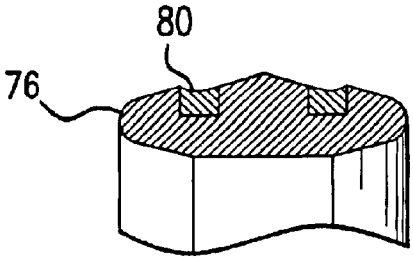
Figure 10:
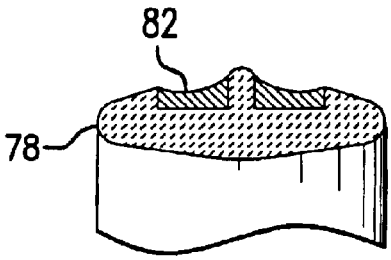

FIGS. 8-10 depict two-groove embodiments of both sintered metal and ceramic substructures at 76 and 78 respectively, each having precious metal or other inserts 80 and 82 formed in the annular grooves thereof, with the exterior surfaces of the inserts of the rings being treated differently to achieve substantially different visual effects. Note, that in either case, the "hard part" protects the softer precious metal part. Note that in this embodiment, the internal surface 83 is shown aligned rather than faceted. Other embodiments may be treated likewise.

Figure 11:
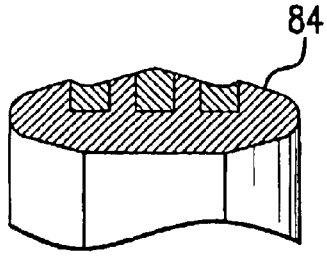

In FIG. 11, a three-groove embodiment is depicted at 84.

Figure 12:
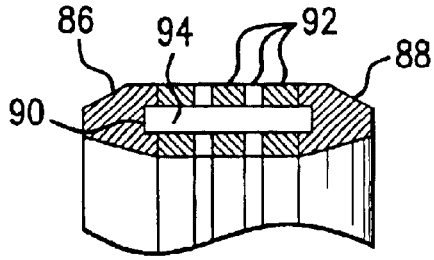
Figure 13:
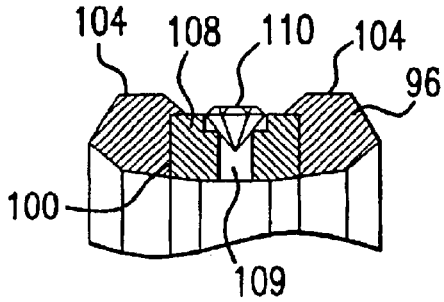
Figure 14:
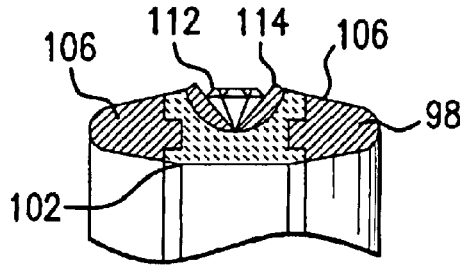

FIGS. 12-14 illustrate alternative embodiments in accordance with the present invention, wherein the hard metal or ceramic components are formed by two or more parts that are affixed together. For example, in FIG. 12, complementary annular sintered or ceramic parts 86 and 88 are provided with shallow bores 90 at several points around facing surfaces of the components, and a plurality of annular components 92 made of at least two materials 92 are sandwiched together and bored at intervals matching the bores 90, such that pins 94 may be extended through the bores in the ring components 92 with the ends thereof being extended into the bores 90 of the hardened ring components 86 and 88 to end mechanical stability to the assembly. The various components 92 would, of course, be epoxied or otherwise bonded together.

In FIGS. 13 and 14 three-part ring assemblies are illustrated at 96 and 98 respectively, with each being comprised of a central band 100 and 102 respectively, sandwiched between and mechanically bonded to a pair of exterior rings 104 and 105 respectively. In the case of the ring assembly illustrated in FIG. 13, for example, the exterior components 104 might be of sintered metal or of ceramic, while the interior band 100 might be of a precious metal, or even of a ceramic or sintered material. In the illustrated configuration, pockets 108 and azure holes 109 are formed in the interior band to receive gemstones 110 which are appropriately secured therein. In other embodiments, that do not provide for a separate interior band, the same cross-section having a cylindrical outer surface and a T-shaped inner surface may be provided by a tube interested into a hole in the unitary substrate, and the gemstone mounted in pockets 108 and holes 109 in a tube mount in like manner. In one embodiment, the holes may be ground through or otherwise machined the substrate using known techniques before or after sintering. The plug or tube may then be inserted using an interference fit, bonding, braising, or other attachment procedure. Where a plain plug is interested using for example gold or platinum, the internal structure of the plug may be machined to a desired shape appropriate to receive the gemstone. The plug may alternatively be machined such as by screw threading or to receive a threaded insert that may be used to attach crowns, stones, or other decorative elements to the ring. Alternatively a screw threaded post may extend from the ring for mating attachment with a threaded screw hole. In another alternative an attachment to the ring body my be accomplished by riveting the attachment to the ring via a rivet attachment hole or by other means. In one embodiment the hole in the ring may be formed by Electrical Discharge Machining (EDM), grinding, or other means.

In yet another embodiment, the plug may take the form of a bridge of material, such as platinum or gold, that extends the entire width of the ring so that the ring body is only a partial annulus. In any of the embodiments, the bridge or plug of material may form a decorative aspect of the ring. For example, where EDM is used, the EDM tool may be selected to provide a desired decorative shape for the fill material. Optionally, embodiments of the material may be machined as decorative voids in the ring body that are not filled.

In one embodiment, a metal mounting fixture such as a metal tube is mounted to the ring substrate such as through a hole formed in the ring and extending radially outward perpendicular or at other desired angle to an outer surface of the ring. The tube may for example be braised into the hole or attached by other means. In one embodiment the metal tube is fabricated in gold and in another embodiment it is fabricated or platinum. Various alloys as are used in the jewelry art may also or alternatively be used. The metal tube or other metal mounting fixture advantageously extends from the surface to provide material from which mounting tongs may be formed and swaged to mount a gemstone, such as a diamond, ruby, emerald, lapis, zirconium, or other gemstone using know gemstone mounting techniques. One such setting is referred to in the art as a tube setting. In one embodiment, the tube has an outer diameter that mates to the hole in the ring substrate to provide an interference fit and an inner diameter that is stepped or shaped to receive the gemstone to a desired depth and optionally at a desired orientation. For example, the tube may provide a larger diameter hole at a top region sized to receive and hold the gemstone, and a lower region sized to prevent the gemstone from entering or falling through. The inner portions of the tube may optionally be shaped in a particular way to receive and hold the gemstone, such as by notching or beveling. Providing a through-hole to from an external surface of the ring to the backside of the gemstone is advantageous as it permits cleaning or the backside of the gemstone without a need to un-mount the gemstone from the ring. It will be appreciated that a mounted gemstone may be incorporated into any of the embodiments described herein. For example, a gemstone may be mounted to faceted or non-faceted rings having inlays or without such inlays. Furthermore, single or multiple gemstones of the same or different types may be used.

In another embodiment, the mounting fixture comprises a plate, inset, plug, or other mechanical fixture having or allowing for a threaded portion or other clasp, clip, or fastener to permit post-ring forming attachment of a gemstone or other ornamentation. Providing such later attachment permits a wide spectrum of customizations to the ring such as addition of different crowns or gemstones, or different gemstone mountings. Permitting such post-ring formation mounting is advantageous as some traditional jewelry making techniques that involve the local heating of metal proximate the mount might cause heat shock and subsequent cracking or shattering of the ceramic, tungsten, or tungsten carbide sintered material.

In the embodiment of FIG. 14, the interior band is depicted as being of a ceramic material sandwiched between and mechanically interlocked to exterior bands 106 made of sintered material or even precious metal, while the gemstones 112 are set in a precious metal 114. In another embodiment, the precious metal 114 is provided in the form of a plug, such as a cylindrical plug, extending through a hole or opening in the ring.

Figure 15:
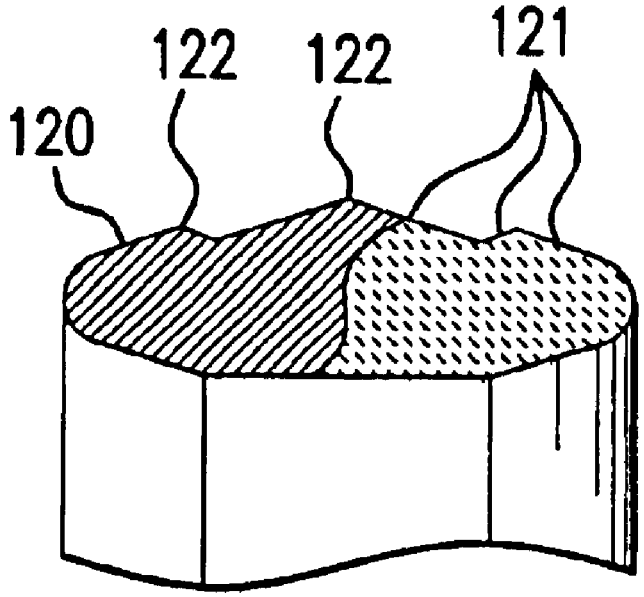
FIG. 15 illustrates a unitary multifaceted hard metal/ceramic ring.

FIG. 15 depicts at 120 a multifaceted unitary ring configuration made of a single, hard metal or ceramic substance. The six highly polished facets 121 on the outer surface of the ring create a unique design and visual impression heretofore not possible using prior art rings making techniques and technologies, because if such configuration had been made, the peaks 122 would have quickly been eroded, destroying the esthetic appearance of the ring.

Figure 16:
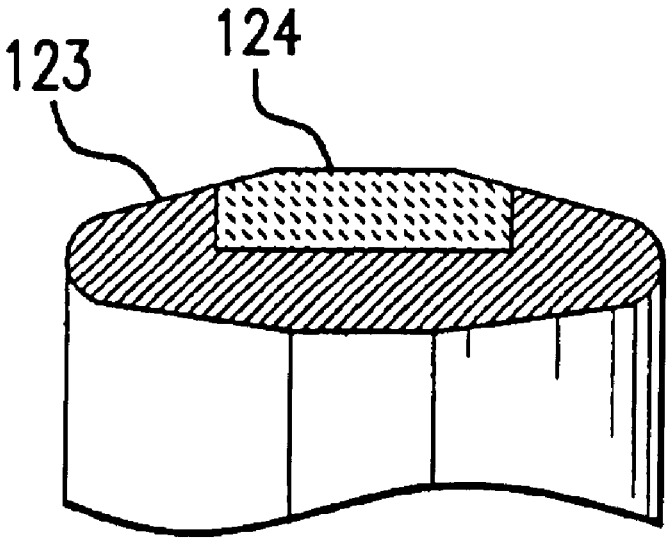
FIG. 16 depicts a precious metal ring having a hard metal/ceramic band embedded therein to provide a protective outer wear surface.

In FIG. 16 of the drawing, still another alternative embodiment is depicted wherein a ring made primarily of precious metal 123 includes an annular insert 124 embedded therein and extending above the uppermost surface of the precious metal component to provide a protective and esthetically pleasing insert.

Alternatively, one or more holes or cavities may be provided around the ring for receiving precious metals and/or set stones.

Figure 7:
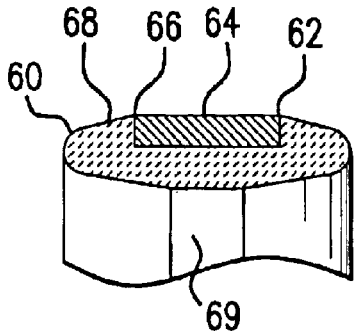
FIGS. 7-14 are partial cross-sections taken through various embodiments illustrating alternative forms of rings made in accordance with the present invention.

It will be appreciated that the embodiments in FIGS. 7-16 also illustrate the variety of faceted and non-faceted surfaces of the basic ring including various cross-sectional configurations of rings having combinations of flats, rounded or curved portions, facets, and the like. By way of example, but not limitation, the embodiment in FIG. 7 shows flat portions on the inner-most diameter and the outer-most diameter but having rounded or curved surfaces on other portions. FIG. 8 shows an embodiment wherein only the inner-most diameter is a flat or faceted surface and other surfaces comprise rounded or curved surfaces. FIG. 10 illustrates an embodiment having a curved inner-most surface as well as all other surfaces being curved or rounded. FIGS. 11 and 12 illustrate exemplary embodiments having primarily flat faceted surfaces. As indicated above, these different curved, rounded, faceted, and/or non-faceted surfaces may be combined in innumerable ways to form a ring having arbitrary cross-sectional shape.

Precious metal bands or inserts, gemstones, crowns, and/or other ornamental and decorative elements may be provided with any of the described curved, rounded, radius, faceted, and/or non-faceted surfaces.

By way of example but not limitation, one embodiment of the inventive ring and method for making such ring, has all flat or faceted surfaces. In an alternative embodiment, these flat or faceted surfaces may have edges or corners between any two surfaces or other combination of surfaces smoothed or rounded such as by grinding or polishing. The degree or amount of grinding or polishing can determine the amount of rounding (such as the radius of the rounding). Machine or hand polishing may be selected to achieve the desired surface. In another embodiment, both inner-most and outer-most ring surfaces can be entirely curved or rounded such as is illustrated for the inner-most surface of the FIG. 10 embodiment. The outer-most surface may similarly be rounded so that the ring has a generally smooth rounded and in some instances a somewhat elliptical appearance. In yet another embodiment, the ring may have flat inner and outer surfaces and flat surfaces joining the inner and outer surfaces in the form of a section cut through a pipe. In even another embodiment, the ring has the form of a continuous curve and having the form of a circular cross section. Note that even multi-faceted rings have some faceted surfaces but need not have all surfaces of a faceted type. Even a pipe-cut ring having flat outer and inner surfaces may be made.

It will also be appreciated that while embodiments of the inventive methods advantageously permit making hard wear resistant flat and frusto-conically shaped surfaces and facets, neither the inventive rings nor the inventive methods for making and fabricating such rings are limited to rings having flat or frusto-conically shaped surfaces.

It will be appreciated by those having ordinary skill in the art in light of the description provided herein that once the sintered ceramic, tungsten, tungsten carbide, titanium, titanium oxide, or any other sintered blank as been formed, the shape or surface profile of the hard substrate may be determined by grinding, machining, or otherwise eroding or altering the surface. Surface polishing using known techniques for polishing surface may be used to achieve a desired surface finish as well as to round or smooth corners between any intersecting flat or faceted surfaces.

Several embodiments of rings made according to the invention and having various cross-sectional configurations and combinations of flat and curved surfaces, facets, materials, inserts and component relationships were illustrated and described relative to FIGS. 7-14 and elsewhere. It has also been described that other embodiments may be treated likewise, that is that the various surface conformations, curved and flat surfaces, faceted and non-faceted surfaces, materials, inserts, and component relationships could be combined in different manners to provide an almost limitless set of rings. Examples of some of these other variations are now briefly described relative to FIGS. 24-37.

Figure 24:
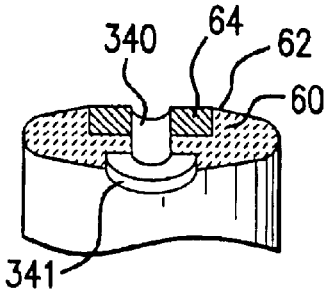
FIGS. 24-32 are partial cross-sections taken through various other embodiments illustrating alternative forms of rings made in accordance with the present invention.
Figure 25:
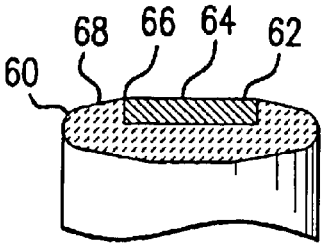
Figure 33:
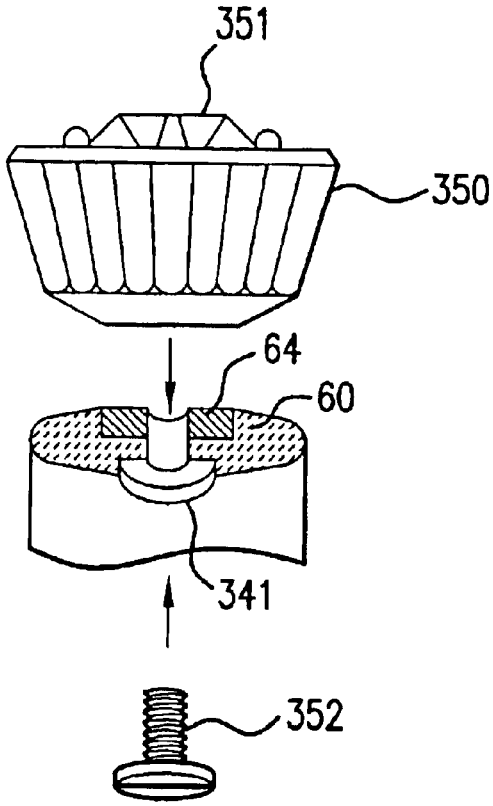
FIG. 33 is a partial cross-section taken through an the embodiment of the ring in FIG. 24 and also showing attachment of a crown carrying a gemstone that is attached with a fastener such as a threaded screw.

In FIG. 25, a sintered metal part 60 in the form of a ring is shown having a wide annular groove 62 formed in its outer surface and filled with a softer precious metal or other material 64. The top surface of material 64 may be flush with the top edges 66 of the ring or may be recessed there beneath to enhance the protective function of the hardened metal part 60. This embodiment of the ring has smooth curved upper and lower surfaces that provide a comfortable fit on the finger due to reduction of any edges. In FIG. 24, the ring of FIG. 24 has been modified to provide a hole 340 having a cylindrical wall surface and extending through to the inner ring surface for the concealed attachment of another decorative items to the ring body or band. In one embodiment, this attachment may be made by a threaded screw that mates to a threaded screw hole in the decorative item 350. In other embodiments, the attachment may be made by rivet, pin, bonding, or other fastener. In the embodiment illustrated a counter bored hole 341 is provided so as to permit the head of attachment screw 352 to lay below the inner ring surface for the comfort of the user. This hole 341 and the screw itself may be plugged or filled if desired. In one embodiment, this decorative item may be crown 350 carrying a gemstone 351 as illustrated in FIG. 33 as well as in FIGS. 35-37. Other embodiments may directly attach a decorative item such as a polished stone or gemstone, metal or other decorative item, mount or setting for a stone or gem, or any other decorative or jewelry item. Advantageously, the mating portion of the decorative item will be shaped to mate to the ring body so as to conceal the attachment. It will be appreciated that any of these rings as well as the other rings illustrated here may have the annular band portion or ring body formed from ceramic, tungsten, tungsten carbide, titanium, or any other material.

Figure 26:
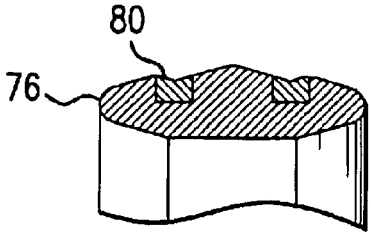
Figure 27:
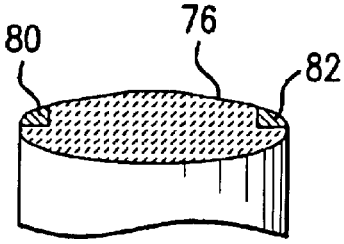

The embodiment in FIG. 26 is similar to that in FIG. 9 except that the central portion of the outer surface of the ring is rounded rather than faceted. The embodiment in FIG. 27 provides a sintered metal body having smooth rounded surfaces and depressions or grooves along edge portions filed with precious metal 80, 82 and illustrating that one, two, three, four, or any number of depressions or grooves may be provided. It will also be noted that although circumferential precious metal filled grooves are illustrated, that the grooves may be provided at other orientations such as circumferential or axially, or a combination of the two. In one embodiment, the groove is a spiral, and in another embodiment multiple crossing spirals are provided. Of course where multiple grooves are provided, different precious metals may be used as a fill. For example, such fill materials may be selected from white gold, yellow gold, platinum, or alloys of these materials.

Figure 28:
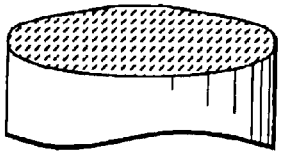

In FIG. 28 there is illustrated a simple ring or band having curved and rounded surfaces and without any groove, precious metal fill, or attachment. Such ring may be formed of ceramic, tungsten, tungsten carbide, or other material according to the invention.

Figure 29:
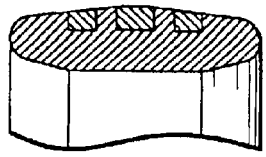

In FIG. 29, there is depicted an embodiment similar to that in FIG. 11 but having a smooth outer ring surface proximate the filled groves rather than the series of multiple curved and raised regions.

Figure 30:
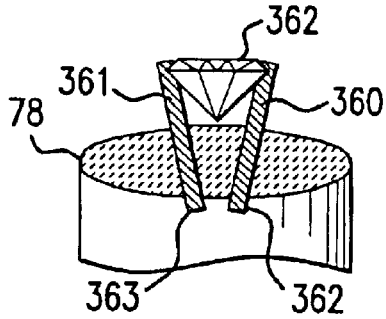

In FIG. 30 there is illustrated an embodiment of the sintered metal or ceramic ring that provides one or more slots or holes to mount precious metal prongs, posts, cups, or the like to be used for mounting stones, gemstones, or the like. The illustrated embodiment shows two (our of a total of four) gold rods 360, 361 extending at angles from the ring body hard part. These rods fit into holes or recesses 362, 363 into the ring body in mechanical interference or as a result of bonding. The upper portions being or malleable material and extending outward from the ring body may be used to mount a gemstone such as a diamond 362. While round posts 360, 361 are illustrated it will be appreciated that slots may be machined into the ring body so that different shaped mounting posts may be attached or that the upper and lower portions may be shaped differently to provide ease of insertion as well as decorative effect and that the angle at which they are inserted may be altered to provide the desired appearance and/or structural effect. While a simple style of a ring body is shown, it will be appreciated that this structure and mounting technique may be applied to any of the other ring body embodiments shown or described herein as well as to the variations described here that are not possible to specifically illustrate.

Figure 31:
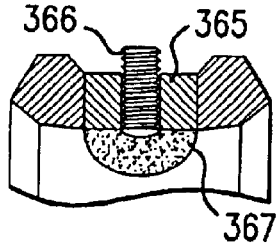
Figure 34:
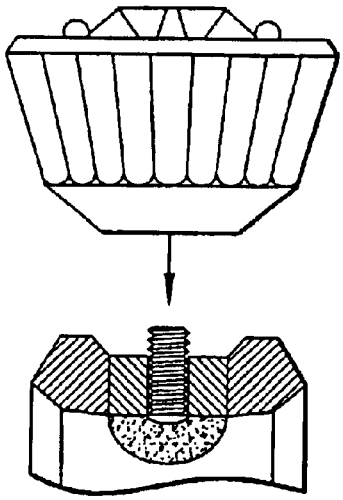
FIG. 34 is a partial cross-section taken through an the embodiment of the ring in FIG. 31 and also showing attachment of a crown carrying a gemstone that is attached with a threaded stud extending from the ring body into a threaded receiver in the crown.
Figure 35:
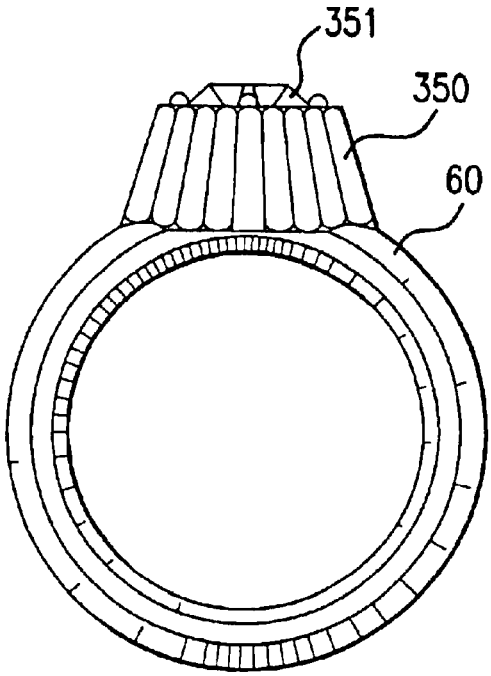
FIG. 35 is a side view illustration of an embodiment of a ring having a ring body and a gemstone carrying crown attached thereto.
Figure 36:
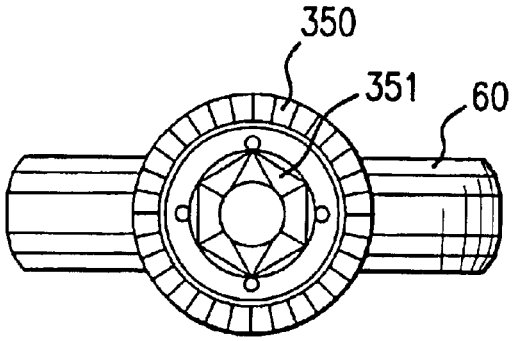
FIG. 36 is a top view illustration of an embodiment of a ring in FIG. 35.
Figure 37:
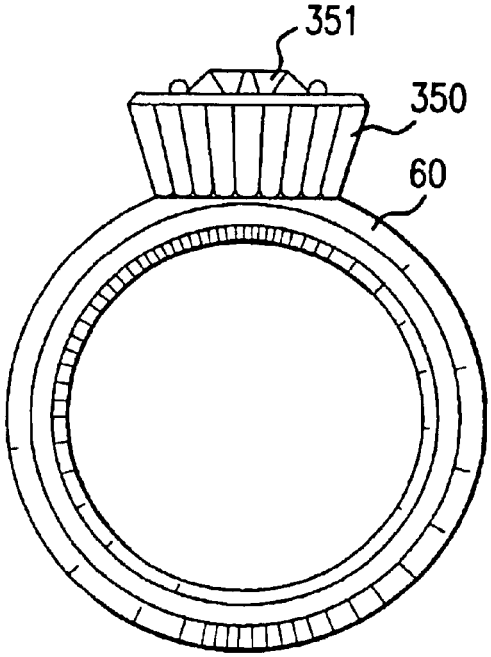
FIG. 37 is a side view illustration of an embodiment of an alternative ring having a ring body and different a gemstone carrying crown attached thereto.

In FIG. 31, there is illustrated another embodiment of the ring body in which a plug 365 has been inserted into an opening or hole 367 formed in the ring body. Advantageously, the plug is made of a precious metal such as gold or platinum. A threaded post or screw 366 is provided to permit attachment of a decorative item to the ring body. Such plugs or suitable shape may alternatively be provided without the hole as a decorative element. For example a plurality of such round, star shaped, diamond shaped, or other shaped holes or depressions may be provided around the outer circumferential surface of the ring. FIG. 34 illustrated the manner in which an exemplary crown 350 carrying a diamond gemstone 351 and other stones may be mounted to the threaded post 366. The final appearance of such a ring is further illustrated in FIGS. 35-36. It will be appreciated that the decorative items may be any type of decorative item, including any one or combination of polished stone, gemstone, diamond, precious metal, gold carving, or any other object as used in the jewelry art.

Figure 32:
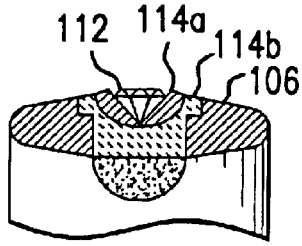

FIG. 32 illustrates an alternative embodiment of a sintered metal or ceramic body ring in which gemstones 112 are set in a precious metal 114 and the precious metal is provided as a plug in a hole in the ring body. A single precious metal may be used or as illustrated a combination of precious metals may be used, such as gold 114*a* and platinum 114*b* to provide a more complex and interesting effect. Multiple ones of such gemstone mounts may be provided. Such mounts may also be combined with, for example, the screw or threaded post mounts for a crown illustrated in FIGS. 33-34.

It will be appreciated that although various embodiments have been illustrated as being ceramic or as being sintered metal; or of having surfaces that were curved, rounded, flat, faceted, or non-faceted, or of being grooved or having a particular number of grooves; rings and other unitary and composite articles made according to the invention may be modified to include different combinations and permutations of the structural and design elements described here and that the invention is not limited only to the particular combinations and permutations of such structural and design elements.

One principal concept of this invention is the provision of an ultra durable hard metal or high tech ceramic type of jewelry that may or may not incorporate precious metals and/or precious gem stones. The invention also provides a unique jewelry manufacturing process that combines hard metals with precious metals in a manner such that the precious metals are flush or recessed slightly below the outer most surfaces of the hard metals over the outer wear surfaces to achieve maximum abrasion and corrosion resistance. This is not to preclude the use of protruding precious metal or gemstone components, but in such cases the protruding components would not be protected by the harder materials. The invention involves the provision of jewelry items made from super hard metals such as tungsten and cemented carbide and high tech ceramics of various colors processed into a predetermined shape then sintered in a furnace and ground and polished into finished form, and/or sintered and then processed such as by grinding and polishing into a predetermined shape and finished form. Additional ornamental adornments such as but not limited to gemstones, crowns, or the like may be added as well. These items may be shaped into concentric circular ring shapes of various sizes and profiles or individual parts may be ground into shapes that can be bonded to a precious metal substrate so as to protect the softer substrate. The hard metal circular designs encompass all types of profiles and cross-sectional configurations for rings, earrings and bracelets. Hard metal items may be processed with various sized and shaped openings distributed around the parameter, with other objects of precious metal gem stones or the like secured into the various openings for cosmetic purposes. Gem stones set in precious metal may be secured into the openings for protection from scratching and daily wear.

Another configuration similar to that depicted in FIG. 11 might include several concentric rings of varying widths and thickness of precious metal or other materials sandwiched between concentric ring's of varying widths, thicknesses and profiles of hard metal. The components are assembled and bonded together with the softer precious metal surfaces being recessed below the adjacent surfaces of the hard metal, thereby causing all of the outer wear surfaces to be protected by the super hard metals surfaces.

Annular rings, earrings and bracelets may also be fashioned by combining variations of precious metal bands with the protective hard metal individual parts bonded onto and into slots or grooves or flat areas of the substrate precious metal bands. These hard metal parts will be positioned to give maximum protections to the precious metal parts.

Articles of jewelry may be created using symmetrical or asymmetrical grid-type patterns. Machined hard metal parts of varying shapes and sizes may be assembled and bonded onto or into a precious metal substrate designed where precious metal is recessed for maximum durability.

Articles of jewelry in accordance with the present invention may be made with various types of hard metals and precious metals where the hard metal is used for both esthetic and structural strength purposes. Hard metal rods of varying shapes and sizes maybe used in conjunction with precious metals to create a unique jewelry design having a very high structural strength. Articles of jewelry may be made entirely of hard metal or a combination of hard metal and precious metal where the cosmetic surfaces of the hard metal are ground to have a faceted look. These facets are unique to hard metal configurations in that precious metal is too soft and facet edges formed in such soft metals would wear off readily with normal everyday use.

The present invention has been described above as being comprised of a molded hard metal or ceramic component configured to protect a precious metal or other component; however, it will be appreciated that the invention is equally applicable to a multifaceted, single-faceted, and non-faceted, highly polished jewelry item made solely of the hard metal composition or ceramic composition. When a durable but non-highly polished jewelry is desired, such as jewelry that is or has portions that have a mat or brushed surface, the surface processing is altered to achieve that desired surface. Furthermore, the present invention relates to a method of making jewelry wherein a rough molded and sintered part is subsequently machined to produce multiple facets, single-facets, curved, and/or other surfaces that can be highly polished or processed to achieve the desired surface finish to provide an unusually shiny ring surface or other surface quality that is highly resistant to abrasion, wear and corrosion. As used in this description, the term facet is intended to include both cylindrical and frusto conical surfaces as well as planar or flat surfaces.

Having now described several embodiments of the invention, we now highlight a few exemplary embodiments of the invention.

In a first aspect, the invention provides an article, such as an item of jewelry, made of material selected from the group consisting of sintered metals and ceramics and having at least one highly polished facet formed on an outer surface thereof. In a second aspect, the invention provides an item of jewelry configured as an annular band having at least one annular groove formed in the outermost surface thereof and includes an insert of precious metal disposed within the groove. In a third aspect, the invention provides an item of jewelry wherein the outer surface of the inset of precious metal is recessed below adjacent extremities of the annular band. In a fourth aspect, the invention provides an item of jewelry wherein at least one gemstone is set in the insert of precious metal, the outermost surface of the gemstone being recessed beneath the adjacent extremities of the annular band. In a fifth aspect, the invention provides an item of jewelry wherein at least one gemstone is set in the insert of precious metal. In a sixth aspect, the invention provides an item of jewelry wherein at least one gemstone is set in a cavity in the band. In a seventh aspect, the invention provides an item of jewelry configured as an annular band embedded in a concentric band of precious metal and having its outermost circumference protruding above the outermost circumference of the concentric band. In an eighth aspect, the invention provides an item of jewelry wherein the annular band is comprised of at least two components axially separated by and joined together by at least one annular band of precious metal. In a ninth aspect, the invention provides an item of jewelry wherein the axially separated annular bands are joined together by a plurality of concentric annular bands made of disparate materials. In a tenth aspect, the invention provides an item of jewelry wherein the annular band includes at least two grooves formed in the outer surface thereof, the two grooves being at least partially filled with a material other than that of the annular band.

In an eleventh aspect, the invention provides a method of providing an article, such as for example, an item of jewelry, where the method comprises the steps of: providing a pressure mold having a cavity of predetermined configuration formed therein; providing a mixture of two or more powdered materials that can be solidified upon the application of pressure and heat; depositing a predetermined quantity of the mixture of powdered materials within the cavity; compressing the quantity of powdered material to form a blank; and sintering the blank to form at least a component of the item of jewelry. This method may further be defined such that the item of jewelry is in the form of an annular band having a groove formed in the outer surface thereof, and further comprising the step of affixing a material within the outer groove, the outer surface thereof being recessed beneath the bounding edges of the groove. This method may be even further defined such that the affixed material is a precious metal that is affixed to the annular ring by brazing. The method may optionally be further defined such that the affixed material is affixed to the annular blank through the use of resinous materials. In a fifteenth aspect, the method may also include the step of finish polishing at least one surface of the annular blank. The method may be further defined such that the annular band has a plurality of facets formed in an outer surface thereof. In a seventeenth aspect, the invention may be further defined such that the affixed material is affixed to the annular blank by a mechanical interlocking of parts. In yet an eighteenth aspect, the inventive method may provide that the blank is severed to form a plurality of sub-blanks, each forming at least a component of the item of jewelry. In a nineteenth aspect, the method may further comprise affixing a gemstone or piece of precious metal to the item of jewelry. In another aspect, the method is further defined such that the component has a plurality of facets formed in an outer surface thereof.

While the certain embodiments of the article and method have been described with particular emphasis on jewelry items and articles, it is understood that neither the inventive article nor the apparatus or method for making the inventive article are limited to jewelry items but extends to all articles having the physical and materials properties described herein.

Alternative Embodiments

The invention also provides system, apparatus, and method or process for creating objects or articles, particularly composite articles, using wear-resistant or other materials, such as tungsten-carbide, poly or mono crystalline ceramics, and mixtures or alloys thereof. In one embodiment, the process is directed to the manufacture of articles having a circular, spherical, or cylindrical cross-section, such as items of jewelry or rings. In some embodiments, the circular, spherical or cylindrical article will be combined with other shapes and/or deformed after fabrication so that the final article has a different shape than circular, spherical or cylindrical. The manufactured articles, particularly items of jewelry items, typically have inlays of a precious metal, such as gold, platinum, or alloys thereof. Characteristics and examples of some such articles and materials have been described elsewhere in the specification. However, it will be clear that the process described is not limited to the manufacture of items of jewelry, but may generally be applied to fabricating a variety of articles.

In a first embodiment of a process according to the present invention, a procedure is provided that permits the inlay of a metal having a lower melting point into one or more grooves or depressions in an underlying support or substrate. For example, the procedure is applicable to inlaying a precious or semi-precious metal such as gold into a groove in a sintered tungsten-carbide or ceramic ring. By lower melting point it is meant a metal (or alloy) having a temperature of fusion that is low relative to that of the material of the substrate.

Figure 17:
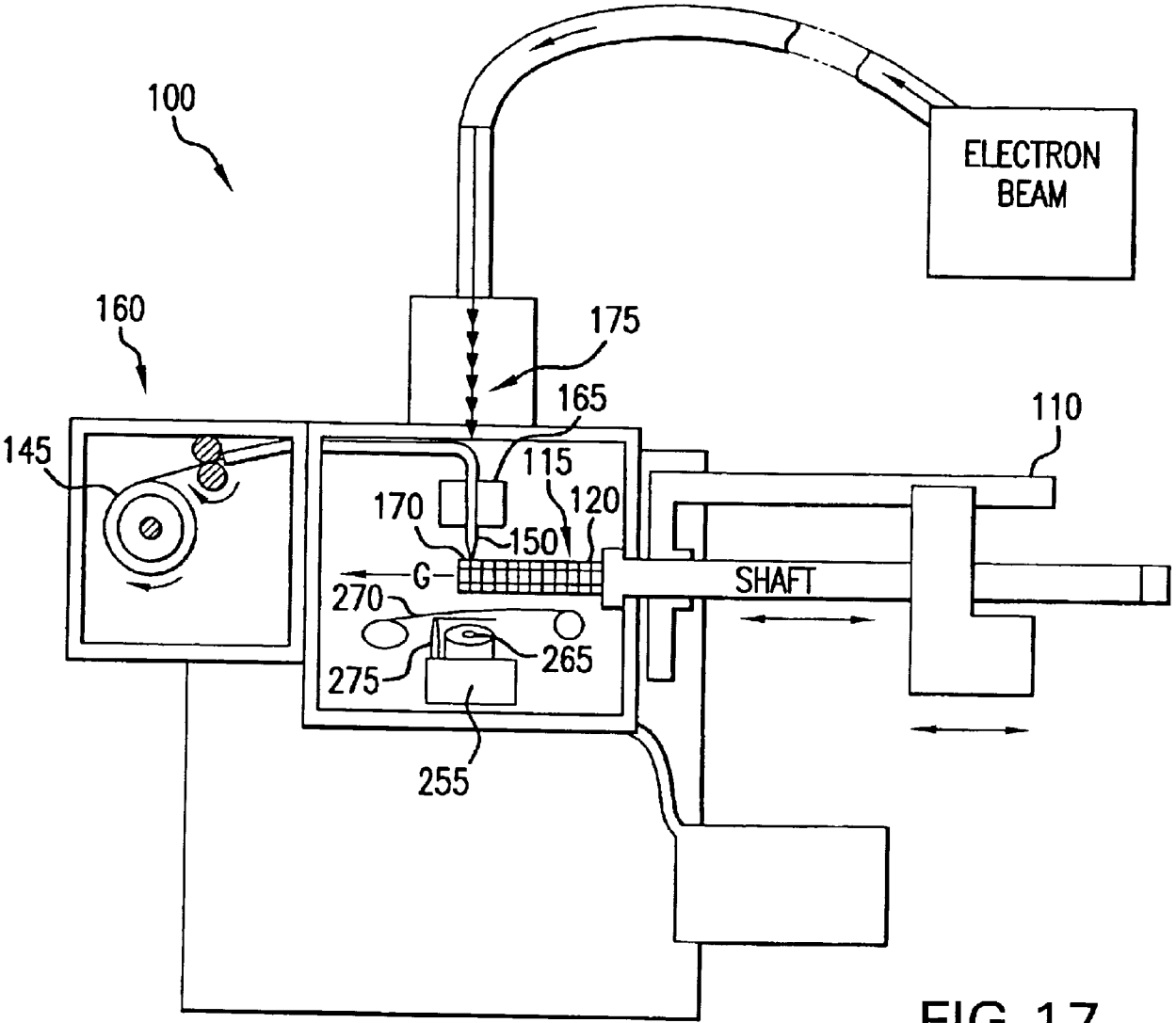
FIG. 17 is a schematic side view of an embodiment of an apparatus for forming an article according the present invention.
Figure 18:
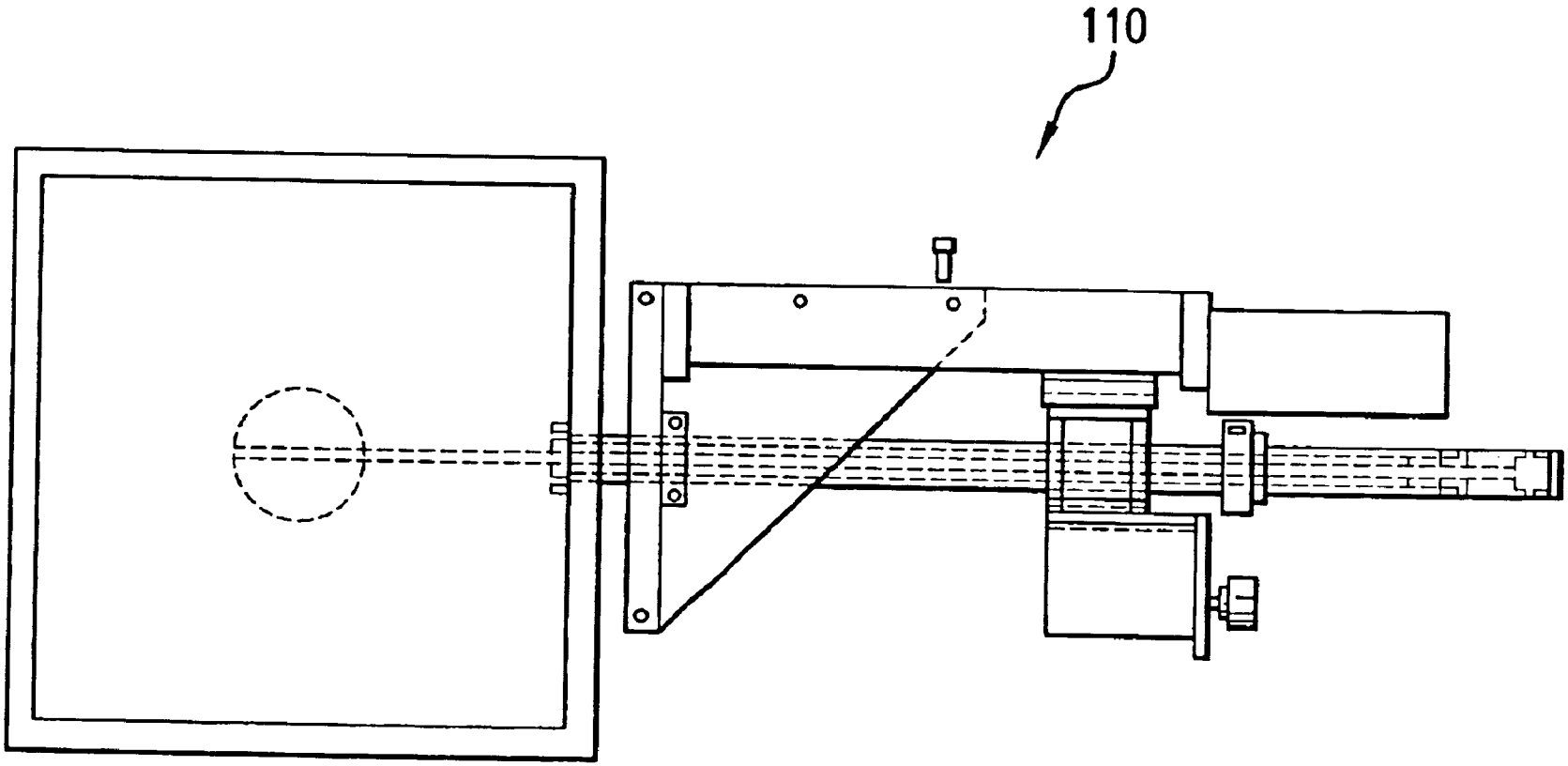
FIG. 18 is a schematic side view of an embodiment of an indexer of the apparatus of FIG. 17.
Figure 19A:
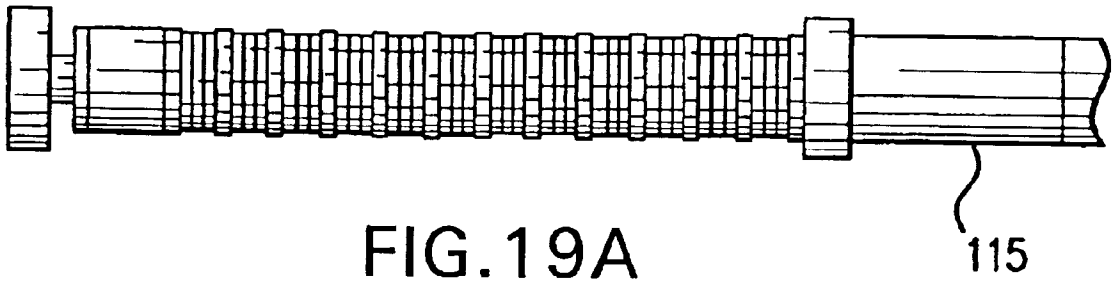
FIGS. 19A and 19B are schematic side views of an embodiment of a mandrel for holding substrates in the apparatus of FIG. 17.
Figure 19B:
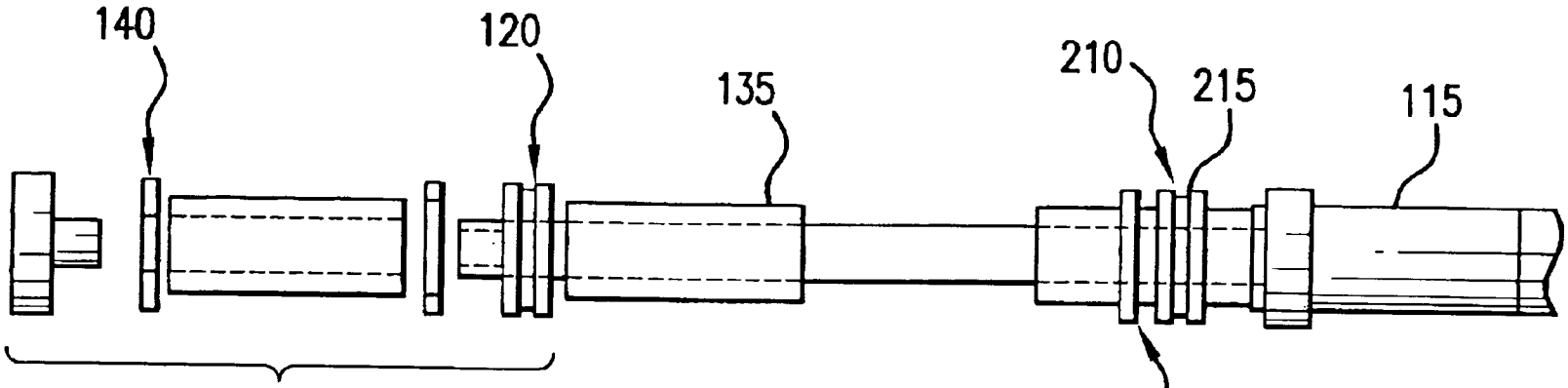
Figure 20:
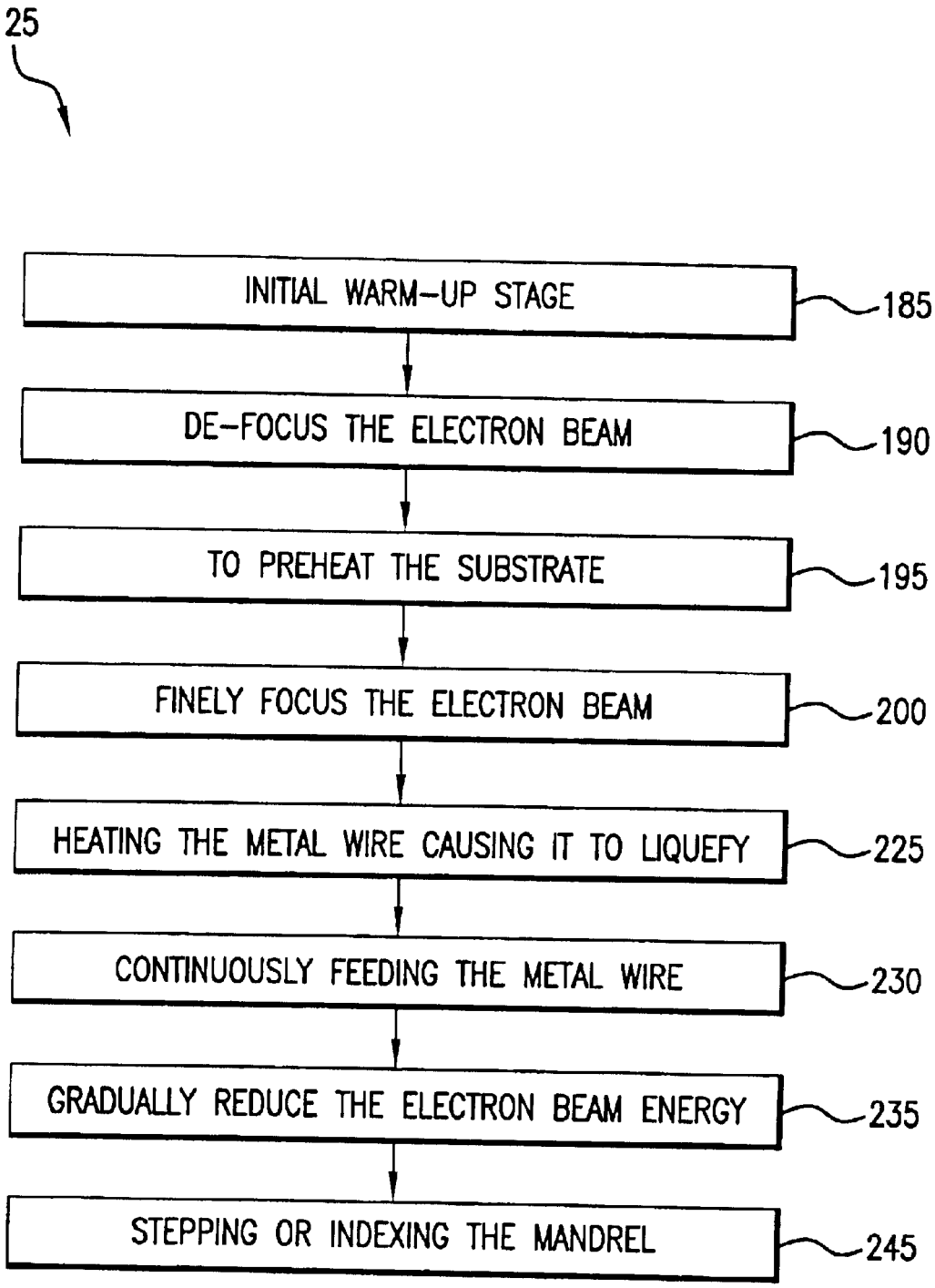
FIG. 20 is a flowchart of an embodiment of a process for manufacturing an article according to an embodiment of the present invention.

An apparatus and process for manufacturing an article according to the present invention will now be described with reference to FIG. 17 through FIG. 20. FIG. 17 is a schematic side view of an embodiment of a substantially oxygen free or vacuum deposition system 100 for forming an article 105 according the present invention. FIG. 18 is a detailed view of an indexer 110 of the system 100 of FIG. 17. FIGS. 19A and 19B arc schematic side views of an embodiment of a mandrel 115 for holding substrates 120. FIG. 20 is a flowchart of an embodiment of a process 125 for manufacturing an article 105 according to an embodiment of the present invention.

The process 125 involves rotating a substrate 120 of the article 105 being manufactured, such as a ring-shaped substrate, inside the substantially oxygen free or vacuum deposition system 100 where a liquid cooled mandrel 115 covered by an electrically conductive sheath 135. In one embodiment, a number of substrates 120 are stacked along the mandrel 115 with thin washer shaped separators 140 to provide alternating substrate, separator substrate, and the like. The electrical conductive sheath 135 can be made, for example, of extruded graphite or a metal-coated ceramic material such as aluminum oxide or mulite.

A spool 145 of metal wire 150 contained within the deposition system 100 is delivered via a delivery mechanism 160 through a nozzle 165 just behind a point or location 170 where an electron beam 175 (e-beam) is focused to strike the rotating substrate 120.

During an initial warm-up stage (Step 185) of the process 125 the electron beam 175 is deliberately de-focused (Step 190) to preheat (Step 195) the substrate 120. Typically the substrate 120 is preheated to a temperature of between about 300 to about 600° F. (150 to 300° C.).

After preheating, the electron beam 175 is finely focused (Step 200) at a focal point 205 coincident with the width of a grooved portion 210 having a recessed groove 215 or depression on a surface of the substrate 120. Simultaneously, the metal wire 150 is fed through the nozzle 165 into the path of the focused electron beam 175, and as a result of the impact of the electrons from the electron beam, heated causing it to virtually instantaneously liquefy (Step 225) and flow into the groove 215 of the substrate 120. Wire 150 is fed (continuously or intermittently) and heated until an adequate amount of metal has been deposited or applied to the groove (Step 230). The energy in electron beam 175 is then gradually reduced (Step 235) to allow solidification of the metal in the groove 215 and cooling of the article 105.

Alternatively, metal wire 150 or the metal in another form (such as for example, in the form of a band or bar) may be placed in the groove 215 by other means or procedure, such as by wrapping the wire into or around the groove, by pressing the metal wire or a metal band into the groove, by squeezing a metal material into the groove, by hammering or swaging the metal into the groove, or by any other mechanical or other means. Once the metal is in the groove, the metal is heated to cause the metal to liquefy and flow and fill or partially fill the groove 215. Optionally, additional wire 150 may be fed continuously or intermittently or as needed over and/or around the metal all ready applied (by whichever means) to further partially or completely fill the groove 215 to the desired amount. This optional further filling with metal wire 150 may be used to provide a clean and tight fill and finish of the metal in the groove.

The mandrel 115 is then stepped or indexed (Step 245) using the indexer 110 shown in FIG. 18 to a center of the grooved portion 210 of the next substrate 120, and the process 125 repeated (Steps 185 to 245) until all substrates have been metalized, that is until all substrates have had metal deposited into the groove 215. Where only a single ring is being made, this mandrel stepping operation need not be performed.

Preferably, a temperature sensor 255, such as an optical pyrometer, is provided within the substantially oxygen free or vacuum deposition system 100 to read the temperature of the substrate 120 and to provide the temperature to a control program (not shown) that precisely controls the delivery mechanism 160, indexing of the indexer 110 and the power and focus of the electron beam 175 to produce an article 105 having a uniform and seamless band of metal about the substrate 120. Alternatively, if the degree of uniformity is not critical, a simple open loop control (not shown) in which the metal wire 150 is fed at a constant rate, the indexer 110 indexed, and the electron beam 175 is powered up and focused at regular intervals, can be provided rather than the feedback control using temperature, but is not preferred.

Because a sensing lens 265 or window of the temperature sensor 255 is susceptible to metal deposition resulting from vaporization of some of the molten metal in the substantially oxygen free or vacuum deposition system, a lens shield 270 may advantageously be interposed between the sensing lens 265 and the substrate 120. The shield 270 can be made from Mylar or other clear (optically transparent) material placed in between the sensing lens 265 and the substrate 120. Preferably, the lens shield 270 is a thin strip or tape of material which is continuously or intermittently moved past sensing lens 265 of the temperature sensor 255 during the metalization process 125, thus allowing the temperature sensor to always read the temperature accurately. Alternatively or in addition thereto, the sensor lens 265 may be covered by a shutter or other movable cover 275 so that the sensor lens is covered at all times while liquid or gaseous metal is present in the system 100. The cover 275 is moved away from the sensor lens 265 during the preheating phase (step 195) to ensure that preheat temperature is reached before the metalization step begins.

As already described, this first process 125 for depositing a layer of material having a lower melting point than the substrate 120 can only be used with certain materials. When the melting temperature of the inlay material is higher than the substrate 120, heating the substrate and/or depositing the molten metal may, at the very least, damage or deform the substrate. Hence, an alternative second process 285 has been developed for inlaying materials having a high melting temperature, such as platinum, or alloys thereof, onto a substrate 120. Such high temperature materials cannot be directly melted into the groove 215 by the first process 125 described above because their melting temperature is as high or higher than the sintering temperature or temperature of fusion of the substrate. This second process 285 can also be used where the melting temperature of the inlay material is below the melting or sintering temperature of the substrate 120 whether the substrate be ceramic, tungsten, tungsten carbide, or a combination of two or more of these materials.

The second process 285 involves the fabrication of the article 105 using swaging and brazing operations. Generally, the metal wire 150 is soldered or welded to form a joint-less metal ring 290 (or otherwise fabricating or machining to form a seamless metal ring or other article) that is then squeezed or swaged onto a sintered substrate 120. A brazing material (not shown) having a melting point lower than both the metal ring 290 and the substrate 120 is applied to a junction (not shown) between the metal ring and the substrate to wick into the junction by capillary action, thereby forming a solid unitary article 105 having substantially no gaps or interstitial recesses between the metal ring and the substrate.

Figure 21:
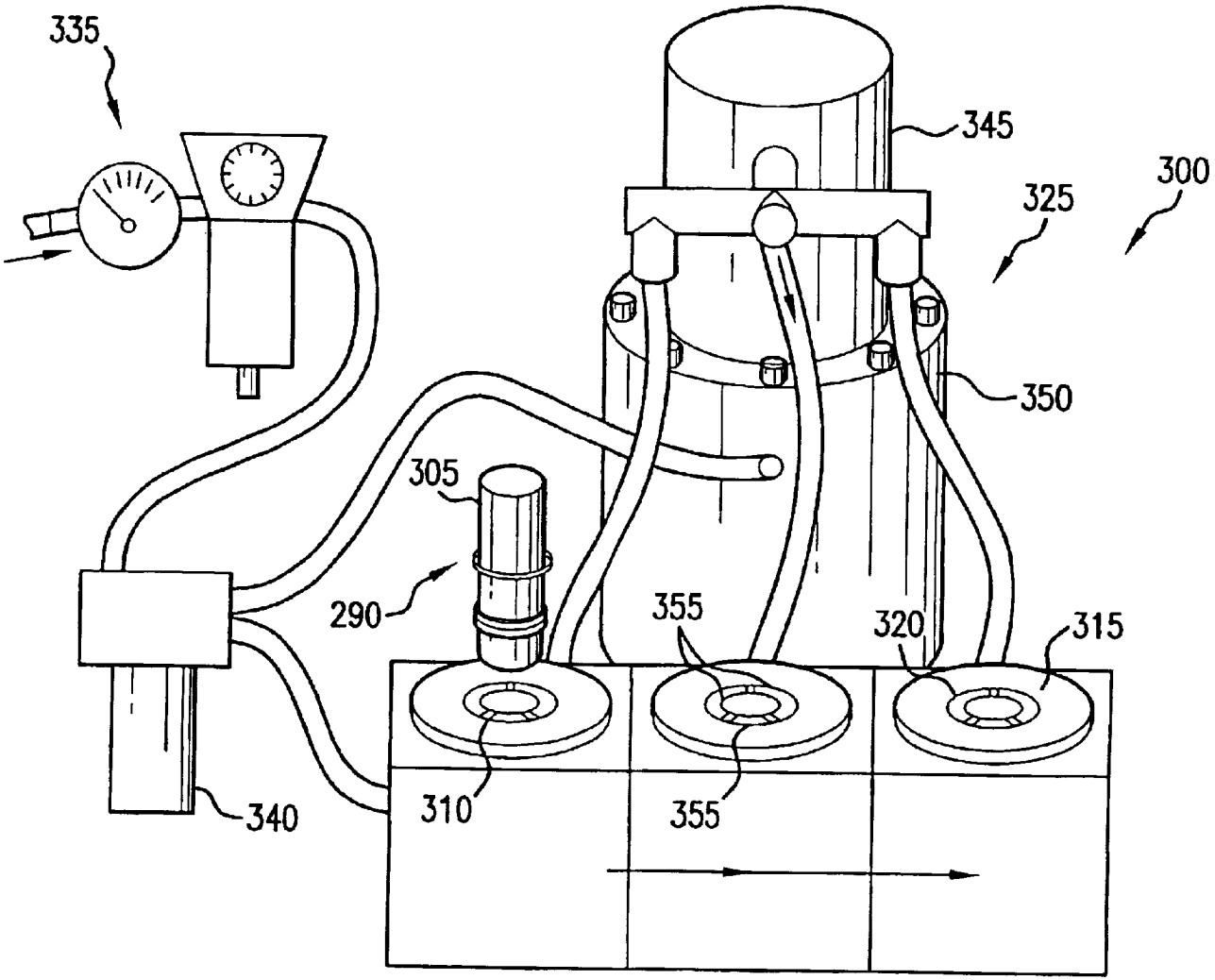
FIG. 21 is a schematic side view of another embodiment of an apparatus for forming an article according the present invention.

FIG. 21 shows a schematic diagram of an exemplary embodiment of a mechanical press 300 suitable for swaging or squeezing the metal ring 290 onto the substrate 120 according the second process 285 of the present invention. The press 300 generally includes several rods or mandrels 305 to hold the substrate 120 with the metal ring 290 disposed thereabout, one or more threaded, tapered top collets 310 into which the mandrel is placed, one or more collet-blocks 315 having tapered openings 320 into which the collet is forced to squeeze or swage the metal ring to the substrate and a pneumatic or hydraulic power cylinder 325 to force the collet into the opening in the collet block. In operation, air or hydraulic fluid from a pressurized supply 335 is admitted to the power cylinder 325 through a manual or electronic valve 340. In the embodiment shown in FIG. 21 the press 300 further includes a hydraulic fluid cylinder 345 to which air is applied and a pneumatic multiplier 350 to convert the relatively low pressure air to a higher hydraulic fluid pressure. Pneumatic multipliers 350 typically raise the pressure of a hydraulic fluid to a pressure from 4 to 12 times that of the pneumatic air. For example, supplying 50 pounds per square inch (psi) of air can produce 600 psi in a hydraulic fluid supplied to the collet-blocks 315.

Figure 22:
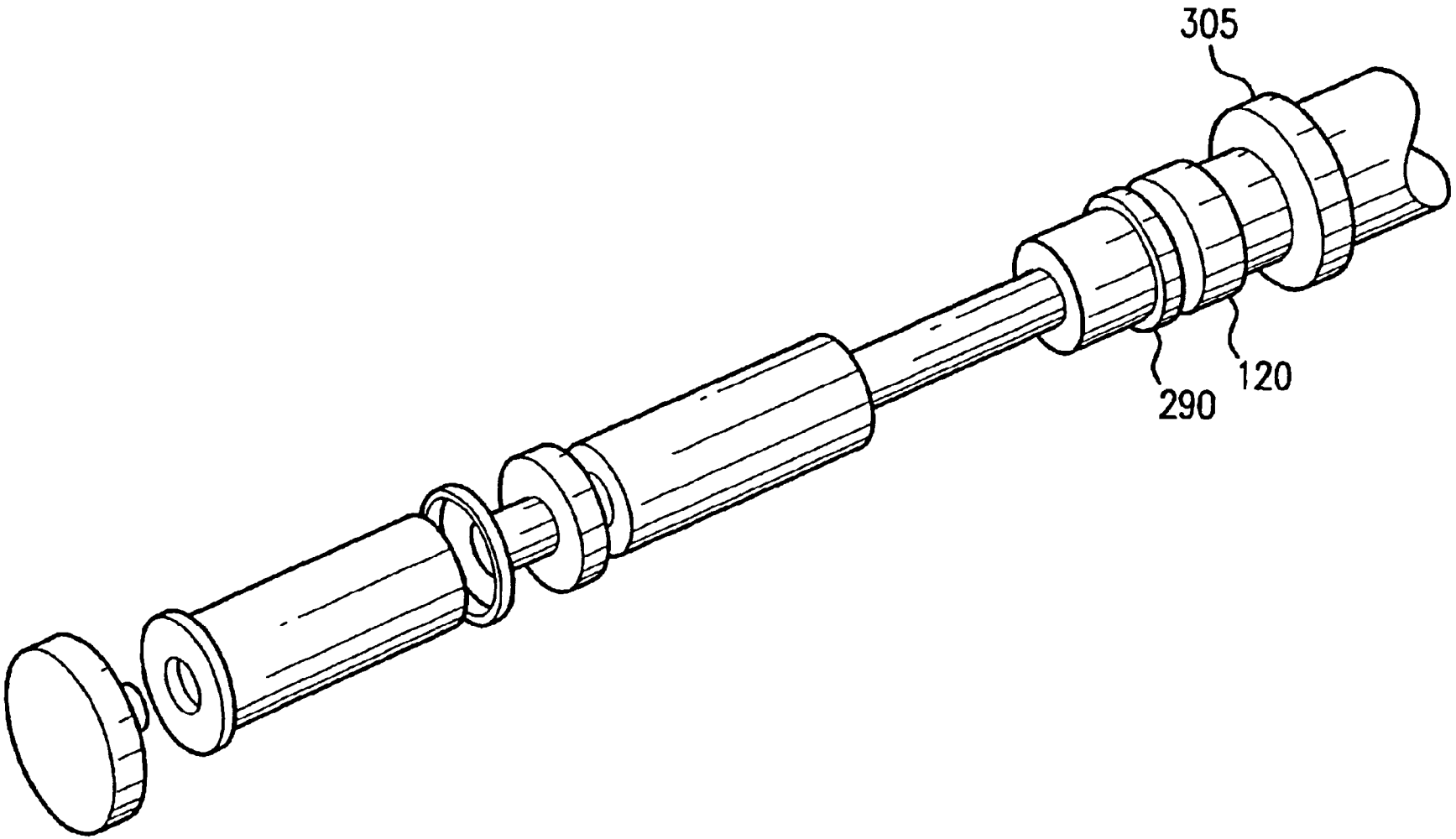
FIG. 22 is a schematic side view of an embodiment of a mandrel for holding substrates in the apparatus of FIG. 21.

Preferably the mandrel 305, shown in detail in FIG. 22, has an outer diameter (OD) sized to re-enforce or support the substrate 120 during the manufacturing process 285. More preferably, the mandrel 305 is of an expanding type that has an OD that can be adjusted to be substantially the same as the inner diameter (ID) of the substrate 120 to apply a counter-force directed radially outward from the substrate thereby preventing it from deforming or cracking when force is applied to the OD of the substrate.

The top collets 310 have a generally hollow cylindrical shape and are threaded at one end to engage a threaded fitting inside the opening 320 in the collet-blocks 315. The collets 310 are tapered from an OD larger than the metal ring 290 to a minimum OD near the threaded end, and are segmented axially to form three or more arcuate prongs or tines 355 that are deformed radially inward as the top collet is pulled into the opening 320 in the collet-block 315. The collet-block 315 also tapers from an ID slightly larger than the OD of the metal ring 290 to an minimum ID slightly smaller than the OD of the substrate 120. As the top collet 310, with the mandrel 305 positioned therein, is pulled into the opening 320 in the collet-block 315, the arcuate tines 355 of the collet move radially inward to swage the metal ring 290 to the substrate 120. This can be accomplished either by pulling the top collet 310 down through the opening 320 in the collet-block 315 or by raising the collet-block over the top collet.

Figure 23:
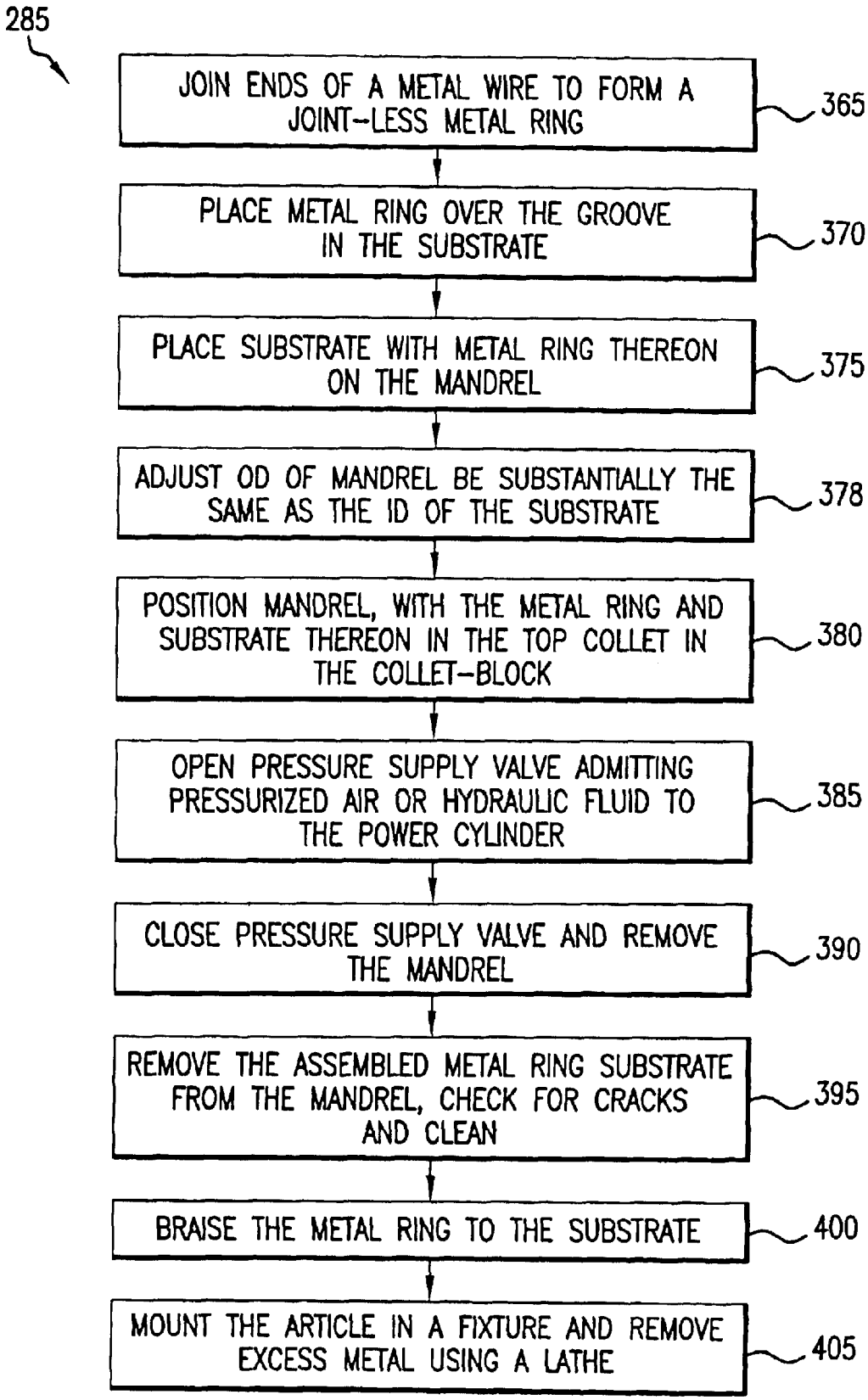
FIG. 23 is a flowchart of an embodiment of another process for manufacturing an article according to an embodiment of the present invention.

A process for manufacturing an article 105 according to the present invention will now be described with reference to FIG. 23. FIG. 23 is a flowchart of steps for manufacturing the article according to the second process 285.

In an initial step, (step 365) ends of a metal wire are joined and soldered to form a joint-less metal ring 290 having an ID larger than an OD of the substrate 120. The metal ring 290 is placed over the groove 215 in the substrate 120 (step 370). The substrate 120, with the metal ring 290 assembled thereon, is then place on the mandrel 305 (step 375). Optionally, if the mandrel 305 is of the expanding type, the OD of the mandrel adjusted to be substantially the same as the ID of the substrate 120 (step 378). The mandrel 305, with the metal ring 290 and substrate 120 assembly thereon is positioned in the top collet 310 in the collet-block 315 (step 380). The pressure supply valve 340 is opened admitting pressurized air or hydraulic fluid to the power cylinder 325 forcing the top collet 310 through the opening 320 in the collet-block 315 and swaging the metal ring 290 to the substrate 120 (step 385). The pressure supply valve 340 is closed and the mandrel 305 removed (step 390). In a preferred embodiment, the process 285 is a multi-step process in which the top collet 310 with the mandrel 305 therein is moved through a sequence of collet-blocks 315 having successively smaller minimum ids so as to yield a snug fit of the metal ring 290 onto the substrate 120, For example, in the embodiment of the mechanical press 300 shown in FIG. 21, the process can be a three step process in which the three collet-blocks 315 shown have openings 320 that are large, medium or small relative to one another.

After the metal ring 290 is swaged to the substrate, the assembly is removed from the mandrel 305, optionally but desirably checked for cracks and then cleaned (step 395) prior to beginning the braising process.

A preferred brazing process (step 400) uses an electron beam 175 similar to that described above in the first process 125 but substituting silver, gold or a eutectic alloy wire 150 as a brazing material to bond the metal ring 290 and the substrate 120 together rather than to fill the groove 215.

In an alternative brazing step (not shown), the brazing can be accomplished by applying a brazing material near the groove 215 in the assembled metal ring 290 and substrate 120 and heating the assembly in a vacuum chamber or other oxygen free environment. The assembly is slowly raised to the proper temperate and then slowly cooled to complete the brazing operation. In yet another alternative brazing step (not shown), the brazing can be accomplished by depositing a thin strip or small amount of brazings material in the groove 215 prior to the swaging operation and then heating the assembly as described above.

After the metalizing process (steps 365 to 400) is completed, the article 105 is mounted into a fixture (not shown) in a lathe (not shown) and the excess metal removed (step 405).

Although described relative to a process for flowing molten precious or semiprecious metal into a groove 215 in a ring-shaped substrate 120, the inventive process 125 is not so restricted. It may, for example, be utilized for any application in which it is desired to deposit one metal material onto a substrate, independent of the form or composition of the substrate. Examples of such alternative applications include: medical devices and implants, dental devices and implants, industrial and electronic devices and components, and so forth.

It is to be understood that even though numerous characteristics and advantages of certain embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

What is claimed is:

1. A method of providing a tungsten-carbide based annular jewelry article having a desired surface profile and including an annular band, which comprises:

providing a mixture of two or more powdered materials which comprises at least 50 weight percent to less than 85 weight percent tungsten carbide to form the annular band of the annular article into a pressure mold having a cavity of predetermined annular configuration and sized formed therein, the size of the mold being greater than the final size of the annular band;

compressing the powdered material mixture at a pressure sufficient to form an annular blank; and sintering the annular blank at a temperature sufficient to form the tungsten-carbide based annular jewelry article so as to be long wearing and virtually indestructible during normal use thereof.

2. The method of claim 1, which further comprises shaping a surface on the annular jewelry article to form the desired surface profile.

3. The method of claim 2, wherein the shaping occurs before the sintering.

4. The method of claim 2, wherein the shaping occurs after sintering but sufficient shaping occurs before addition of a decorative component, which comprises a precious metal, to the annular article so as to minimize loss of the precious metal due to further shaping.

5. The method of claim 1, wherein the annular article is provided with at least one depression comprising a groove, slot, or hole formed in an outer surface thereof.

6. The method of claim 5, wherein the at least one depression is formed before the sintering.

7. The method of claim 6, further comprising the step of affixing at least one material within the at least one depression.

8. The method of claim 7, wherein the at least one material affixed comprises a mounting fixture to facilitate mounting of a decorative component to the annular jewelry article.

9. The method of claim 1, further comprising the step of finish polishing at least one outer surface of the annular article.

10. The method of claim 1, further comprising a step of modifying the outer surface to provide a non-polished portion thereof.

11. The method of claim 1, wherein the annular article has at least one flat or curved facet formed in an outer surface thereof.

12. The method of claim 1, wherein the mixture comprises at least 81 weight percent tungsten carbide.

13. The method of claim 1, wherein one powdered material is tungsten carbide and the other is a binder.

14. The method of claim 13, wherein the binder is nickel, cobalt, or a combination thereof.

15. The method of claim 1, which further comprises placing the jewelry article on a person's body to display the annular article.

16. A method of providing a tungsten-carbide based annular jewelry article having a desired surface profile and including an annular band which comprises: providing a mixture of two or more powdered materials which consist essentially of at least 50 weight percent tungsten carbide to form the annular article into a pressure mold having a cavity of predetermined annular configuration and sized formed therein, the size of the mold being greater than the final size of the annular band; compressing the powdered material mixture at a pressure sufficient to form an annular blank; and sintering the annular blank at a temperature sufficient to form the tungsten-carbide based annular jewelry article.

17. The method of claim 16 wherein the mixture consists essentially of 50 to 90 weight percent tungsten carbide.

18. The method of claim 16 wherein the mixture includes at least 81 weight percent tungsten carbide.

19. The method of claim 16 wherein the mixture includes less than 85 weight percent tungsten carbide.

20. The method of claim 16, wherein the mixture of two or more powdered materials further consists essentially of a binder.

21. The method of claim 20, wherein the binder consists essentially of two powdered binder metals.

22. The method of claim 21, wherein the powdered binder metals are nickel, cobalt, or a combination thereof.

23. The method of claim 16 wherein the mixture includes 85 weight percent to 90 weight percent tungsten carbide.

24. The method of claim 16, wherein one powdered material is tungsten carbide and the other is a binder.

25. The method of claim 24, wherein the binder is nickel, cobalt, or a combination thereof.

26. The method of claim 16, which further comprises shaping a surface on the annular jewelry article to form the desired surface profile.

27. The method of claim 26, wherein the shaping occurs before the sintering.

28. The method of claim 26, wherein the shaping occurs after sintering but sufficient shaping occurs before addition of a decorative component, which comprises a precious metal, to the annular article so as to minimize loss of the precious metal due to further shaping.

29. The method of claim 16, wherein the annular article is provided with at least one depression comprising a groove, slot, or hole formed in an outer surface thereof.

30. The method of claim 29, wherein the at least one depression is formed before the sintering.

31. The method of claim 30, further comprising the step of affixing at least one material within the at least one depression.

32. The method of claim 31, wherein the at least one material affixed comprises a mounting fixture to facilitate mounting of a decorative component to the annular jewelry article.

33. The method of claim 16, further comprising the step of finish polishing at least one outer surface of the annular article.

34. The method of claim 16, further comprising a step of modifying the outer surface to provide a non-polished portion thereof.

35. The method of claim 16, wherein the annular article has at least one flat or curved facet formed in an outer surface thereof.

36. The method of claim 16, which further comprises placing the jewelry article on a person's body to display the annular article.

* * * * *

UNITED STATES PATENT AND TRADEMARK OFFICE

CERTIFICATE OF CORRECTION

PATENT NO. : 6,928,734 B1
DATED : August 16, 2005
INVENTOR(S) : West

It is certified that error appears in the above-identified patent and that said Letters Patent is hereby corrected as shown below:

Title page,
Item [54], Title, change from "JEWELRY RING AND METHOD OF MANUFACTURING SAME" to -- METHOD OF MAKING ANNULAR, TUNGSTEN-CARBIDE JEWELRY ARTICLES --.
Item [56], References Cited, FOREIGN PATENT DOCUMENTS, after "AU 208883" change "5/1956" to -- 8/1956 --.
OTHER PUBLICATIONS, add the following reference: -- Boccia® Titanium, The Boccia Titanium Jewelry Collection, Universal Watch Co., Inc., Framingham, MA 01702, August 6, 2002. --.

Signed and Sealed this

First Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,928,734 B1
DATED : August 16, 2005
INVENTOR(S) : West

It is certified that error appears in the above-identified patent and that said Letters Patent is hereby corrected as shown below:

Title page,
Insert Item:

-- Related U.S. Application Data

[63] Continuation-in-part of application No. 09/571,583, filed on May 15, 2000, now Pat. No. 6,553,667, which is a continuation-in-part of application No. 09/149,796, filed on Sep. 8, 1998, now Pat. No. 6,062,045.

[60] Provisional application No. 60/058,163, filed on Sep. 8, 1997. --.

Column 1,
Line 4, insert the following:

-- CROSS REFERENCE TO RELATED APPLICATIONS

This application is a continuation-in-part of Application No. 09/571,583, filed on May 15, 2000, now Patent No. 6,553,667, which is a continuation-in-part of Application No. 09/149,796, filed on September 8, 1998, now Patent No. 6,062,045, which claims the benefit of provisional Application No. 60/058,136, filed on September 8, 1997, the entire content of each of which is incorporated herein by reference thereto. --.

Signed and Sealed this

Twenty-first Day of February, 2006

JON W. DUDAS
*Director of the United States Patent and Trademark Office*